US011414927B1

(12) United States Patent
Popat

(10) Patent No.: US 11,414,927 B1
(45) Date of Patent: Aug. 16, 2022

(54) EXTERNAL MOTORIZED ACTUATOR FOR WAND-OPERATED VENETIAN BLINDS

(71) Applicant: Pradeep Pranjivan Popat, Arlington, VA (US)

(72) Inventor: Pradeep Pranjivan Popat, Arlington, VA (US)

( * ) Notice: Subject to any disclaimer, the term of this patent is extended or adjusted under 35 U.S.C. 154(b) by 631 days.

(21) Appl. No.: 16/396,751

(22) Filed: Apr. 28, 2019

Related U.S. Application Data

(60) Provisional application No. 62/664,239, filed on Apr. 29, 2018.

(51) Int. Cl.
*E06B 9/78* (2006.01)
*E06B 9/322* (2006.01)

(52) U.S. Cl.
CPC ..... *E06B 9/78* (2013.01); *E06B 9/322* (2013.01); *E06B 2009/3222* (2013.01)

(58) Field of Classification Search
CPC . E06B 9/78; E06B 9/322; E06B 9/326; E06B 9/368; E06B 9/74; E06B 2009/3222
See application file for complete search history.

(56) References Cited

U.S. PATENT DOCUMENTS 4,956,588 A * 9/1990 Ming ..... E06B 9/32 160/331
4,979,550 A * 12/1990 Long ..... E06B 9/74 160/5
5,444,339 A * 8/1995 Domel ..... E06B 9/307 318/17
5,495,153 A * 2/1996 Domel ..... E06B 9/368 318/17
5,547,008 A * 8/1996 Sullivan ..... E06B 9/32 160/176.1 P
5,603,371 A * 2/1997 Gregg ..... E06B 9/307 160/176.1 P
5,760,558 A * 6/1998 Popat ..... E06B 9/32 318/480
8,051,536 B2 * 11/2011 Konecek-Hughes .... A47H 1/06 16/96 R
8,643,321 B2 * 2/2014 Leivenzon ..... E06B 9/72 318/468
8,981,681 B2 * 3/2015 Malekpour ..... E06B 9/68 318/40
9,822,939 B2 * 11/2017 Krause ..... F21V 14/04
(Continued)

OTHER PUBLICATIONS

Webpage at http://www.intelliblinds.com/intellidapter.html, published circa 2014 by Pradeep Popat in Arlington, VA, USA. Shows a motor mount for a motorized Venetian blind which provides three degrees of freedom of motor movement—vertical, lateral, and rotary—while reacting the torque produced by the gearmotor.

*Primary Examiner* — Johnnie A. Shablack

(57) ABSTRACT

A headrail-mounted motorized actuator for wand-operated venetian blinds has a bracket which attaches to the front of the headrail with a magnet. The bracket has a ferroelectric surface oriented perpendicularly to the headrail. A motor assembly has an output shaft and a second magnet which holds the motor assembly to the ferroelectric surface, so that the output shaft is parallel to the ferroelectric surface. The position and orientation of the motor assembly can be adjusted by moving and rotating the motor assembly on the ferroelectric surface.

4 Claims, 29 Drawing Sheets

(56) References Cited

U.S. PATENT DOCUMENTS

| | | | | |
|---|---|---|---|---|
| 9,879,475 | B2 * | 1/2018 | Mullet | E06B 9/70 |
| 10,240,391 | B2 * | 3/2019 | Watkins | E06B 9/42 |
| 2008/0023157 | A1 * | 1/2008 | Ganzi | E06B 9/323 160/176.1 R |
| 2008/0303686 | A1 * | 12/2008 | Mosbrucker | E06B 9/322 340/4.61 |
| 2017/0362888 | A1 * | 12/2017 | Vinogradova | E06B 9/32 |
| 2018/0283093 | A1 * | 10/2018 | Tseng | E06B 9/323 |
| 2021/0131176 | A1 * | 5/2021 | Schmidt | E06B 9/38 |

* cited by examiner

18E

EXTERNAL MOTORIZED ACTUATOR FOR WAND-OPERATED VENETIAN BLINDS

CROSS-REFERENCE TO RELATED APPLICATIONS

This application claims the benefit of Provisional Patent Application Ser. No. 62/664,239, filed 2018 Apr. 29 by the present inventor.

BACKGROUND

This invention is in the field of motorized window-shading systems, and specifically systems for motorization of wand-operated venetian blinds.

Venetian Blinds

Venetian blinds, and especially horizontal venetian blinds, are among the most widely-used and cost-effective window-shading devices. A typical horizontal blind offers two degrees of window-shading adjustment:

The slats can be raised or lowered to vary the shaded area of the window.

The slats can be tilted to vary the daylight admitted by (and the view through) the shaded area of the window.

In most blinds, the slat-tilt function is operated by twisting a control wand.

Motorization of Slat-Tilt Function

Motorization of venetian blinds offers many benefits, especially in conjunction with remote or automated control systems. Such benefits include convenience, energy savings, and enhanced security. Most of these benefits can be achieved through motorization of just the slat-tilt function, which is simpler and requires less motor torque than motorization of the slat-raising function. As a result, many commercially-produced blind-motorization devices have been limited to motorizing just the slat-tilt function.

Motorization of the slat-tilt function is typically achieved by installation of a motor inside the blind's headrail, referred to herein as internal motorization. Internal motorization is aesthetically advantageous because the motorization components are not visible. However, it requires removal of the headrail (if the host blind is already installed), and a single motor design will generally be compatible with only a subset of the headrail designs on the market.

Alternatively, blind-motorization devices are known in the art which are located outside the host blind's headrail, significantly reducing required installation labor. Such devices are referred to herein as external motorization devices. External motorization can be particularly advantageous in retrofit applications is which a host blind is already installed and in use.

External Motorization of Wand-Operated Blinds

External motorization of the slat-tilt function is particularly appealing for wand-operated blinds because it is relatively easy to couple a motor to the wand or control shaft of a wand-operated blind. However, in order to be commercially successful, an external motorized actuator for wand-operated blinds must meet four criteria:

It must be small and visually unobtrusive.

It must be easy to install (preferably without tools, and certainly without need for removal of, or modifications to, the host blind).

It must be capable of accurately and repeatably rotating the wand or control shaft to predetermined or programmable positions (e.g. fully open or fully closed), i.e. it must not introduce excessive backlash in the drivetrain between the motor and the control shaft.

It must be compatible with virtually all wand-operated blinds.

These requirements impose conflicting constraints on the design of the actuator. In particular, broad compatibility with various blind designs is difficult to achieve while still meeting the other requirements.

Key Design Variations among Wand-Operated Blinds

To facilitate discussion of the challenges in meeting the above-stated compatibility requirement, the following paragraphs describe a typical wand-operated blind in more detail, and then discuss the key design variations among such blinds.

FIG. 1: Wand-Operated Horizontal Venetian Blind and Coordinate System

FIG. 1 shows a perspective view of a section of a conventional wand-operated horizontal venetian blind, blind 20, that includes a vertical array of horizontal slats 21 suspended from a headrail 22 which has a front, front 23.

As is typical of horizontal blinds, blind 20 offers two degrees of window-shading adjustment: slats 21 can be raised or lowered together to vary the occluded area of the host window (not shown), and slats 21 can be tilted together to vary the admitted daylight and the view through the occluded area of the host window. The slat-tilt function of blind 20 is operated by twisting a control wand 24; the control wand is coupled to and rotates a control shaft 25 of a tilter mechanism 26, which in turn rotates a tilt rod (not shown) located inside the headrail. The tilt rod has two or more drums (not shown) along its length from which the slats are suspended via ladder strings (not shown); as the tilt rod rotates, the drums also rotate, causing the ladder strings to tilt the slats.

Such a blind is typically mounted to a window frame (not shown) or a wall (not shown) by means of brackets at each end of the headrail; one such bracket is shown as an end bracket 27. Bracket 27 has a side 28 which is parallel to (and covers) a proximal side of headrail 22. Optionally, additional mounting brackets along the length of the blind may be provided.

Coordinate System

FIG. 1 also shows a coordinate system, consisting of labeled X, Y, and Z axes, that is used herein to facilitate description of the geometry of various objects. The coordinate system is referenced to a subject blind (e.g. blind 20 in the case of FIG. 1): the X-Z plane is parallel to the front of the headrail (e.g. front 23), the Y-Z plane is parallel to the side of the headrail (and thus to side 28 of bracket 27), and the X-Y plane is parallel to the top of the headrail (e.g. the top of headrail 22). Because the coordinate system is referenced to a subject blind, these relationships are independent of the orientation of the blind in the real world.

However, while the orientation of the coordinate system is fixed relative to the subject blind, its location (i.e. the location of its origin) is floating and depends on what is being described. For example, front 23 of headrail 22 and the back (not labeled) of headrail 22 are both considered to be in the X-Z plane, although they are displaced in the Y axis.

The coordinate system defines the meaning of directional and dimensional terms which may be used herein:

Height refers to an extent along the Z axis, width to an extent along the X axis, and depth to an extent along the Y axis.

Upward and downward refer to the positive-Z and negative-Z directions, respectively; outward and inward to the positive-Y and negative-Y directions, respectively; and rightward and leftward to the positive and negative X directions, respectively.

The coordinate system is also used herein to refer to drawing planes. For example, a drawing in the X-Z plane of the objects in FIG. 1 would show a front view of blind 20.

FIGS. 2A-2D: Variations in Control Shaft 25

The disposition, size, and shape of control shaft 25 can vary significantly among blind designs. To help illustrate these differences, FIGS. 2A-2D provide close-up views of some of the elements previously shown in FIG. 1.

FIG. 2A: Close-Up Perspective View of Control Shaft

FIG. 2A is a perspective view that shows headrail 22, front 23, control shaft 25, bracket 27, and side 28. Control shaft 25 comprises a rod 29 and an eye 30. Different blind designs can vary in the control shaft disposition, size, and shape in the following ways:

- In most blinds, control shaft 25 protrudes from front 23 of headrail 22 (which is the case in FIG. 2A), and the Z-axis distance between the point at which it protrudes and the top of the headrail can vary significantly from blind to blind. In other blinds, the control shaft protrudes from the bottom of the headrail; in such blinds, the Z-axis distance between the top of the headrail and the point at which it protrudes also varies (with the height of the headrail), and the Y-axis distance between the point at which it protrudes and the front of the headrail can also vary from blind to blind.
- The X-axis distance between the point at which control shaft 25 protrudes from headrail 22 and side 28 can vary significantly from blind to blind.
- The axis of rotation of control shaft 25 is in the Y-Z plane. Thus, the axis of rotation of control shaft 25 is parallel to the side of the headrail and to side 28 of end bracket 27. The inclination angle of control shaft 25 (and its axis of rotation) in the Y-Z plane (e.g. the angle between the axis of rotation and the Z-axis) can vary significantly from blind to blind.
- The length and diameter of control shaft 25 and the outer and inner diameters of eye 30 can vary significantly from blind to blind.
- In some blinds, eye 30 is an integral part of rod 29 while in other blinds, eye 30 is a separate part which can be attached to and removed from rod 29.

The following figures discuss these variations and their impacts in more detail.

FIG. 2B: Side View of Control Shaft

FIG. 2B is a side view (i.e. in the Y-Z plane) of headrail 22, front 23, control shaft 25 (and its rod 29 and eye 30) and side 28. FIG. 2B also shows a vertical distance $\Delta Z$ along the Z-axis, as well as a horizontal distance $\Delta Y$ along the Y-axis, between the upper edge of headrail 22 and the center of eye 30. The aforementioned variations in the length of control shaft 25, its inclination in the Y-Z plane, and the location of the point at which it protrudes from headrail 22 in the Y-Z plane cause a significant blind-to-blind variation in the distances $\Delta Y$ and $\Delta Z$.

The outside diameter (OD) of eye 30 is also shown and labeled, while the inside diameter (ID) of eye 30 is shown but not labeled. As previously stated, these diameters can vary significantly among wand-operated blinds.

FIG. 2C: Front View of Control Shaft

FIG. 2C is a front view (i.e. in the X-Z plane) of headrail 22, front 23, and control shaft 25 (and its rod 29 and eye 30), along with bracket 27. FIG. 2C also shows a horizontal distance AX along the X-axis between control shaft 25 and the proximal edge of bracket 27, as well as a thickness T of eye 30. The distance AX and thickness T vary significantly among wand-operated blinds.

FIGS. 2D-2F: Perspective Views of Control Shaft Configurations

FIGS. 2D-2F show three common variations in the control shaft design for wand-operated blinds:

- FIG. 2D shows a control shaft 25A which has a removable eye 30A having an hole 31A. Eye 30A is in the form of a roughly S-shaped metal clip, one end of which fits in a hole (not shown) in a rod 29A. A collar 32A can be pulled down over eye 30A, securing it in place. Typically, this type of eye is relatively thin (i.e. has a small thickness T in the context of FIG. 2C), but also usually has a relatively large ID and OD. This type of eye is often not perfectly circular and its center may be offset from the axis of rotation of control shaft 25A.
- FIG. 2E shows a control shaft 25B which has a relatively thin rod 29B and an integral (non-removable) eye 30B. Eye 30B has a relatively small hole 31B (whose diameter is also referred to herein as the Inside Diameter, or ID, of the eye) and OD, but is relatively thick.
- FIG. 2F shows a control shaft 25C which has a relatively thick rod 29C and an integral eye 30C having a hole 31C. Eye 30C has a relatively small ID and OD, and is also relatively thin.

Challenges Associated with Achieving Broad Compatibility

With reference to FIGS. 2A-2D, the two most significant challenges in achieving broad compatibility in a device for external motorization of wand-operated blinds can now be discussed. These challenges are:

- providing rotary motion around the appropriate axis and at the appropriate point in space so that it can be coupled to control shaft 25, and
- physically coupling the rotary motion to control shaft 25.

Providing Rotary Motion Around the Appropriate Axis and at the Appropriate Point in Space Referring again to FIG. 2B, it can be seen that control shaft 25 is inclined with respect to the Z-axis in the Y-Z plane. This inclination angle varies substantially among wand-operated blinds. For example, a survey of blinds across U.S. office buildings revealed a shaft inclination angle range of 10 degrees to 40 degrees. Thus, in order to achieve broad compatibility, an external motorization device must have an output member that has an axis of rotation that is adjustable in the Y-Z plane.

In addition, as noted previously, the length of control shaft 25 can also vary substantially from blind to blind. For example, a survey of blinds in selected U.S. office buildings revealed a shaft length range of 8.9 mm to 30.5 mm.

Further, as noted previously, the Y-axis and Z-axis locations of the point at which control shaft 25 protrudes from the headrail can also vary substantially from blind to blind.

The three aforementioned variations result in significant variation in the distances AZ and AY among wand-operated blinds. Thus, in order to achieve broad compatibility, an external motorization device must have an output member whose terminus has an adjustable location in the Y-Z plane.

System of U.S. Pat. No. 5,760,558

The need for an output member with an axis of rotation that is adjustable in the Y-Z plane, and which has a terminus whose location is adjustable in the same plane, was first recognized in U.S. Pat. No. 5,760,558. This patent also showed that this requirement could be met by providing three degrees of mechanical freedom in the drivetrain between the motor and the control shaft. The preferred embodiment shown in U.S. Pat. No. 5,760,558 provides the three degrees of mechanical freedom in the following ways:

- A motor mount, attached to the headrail of the host blind, allows the motor to tilt in the Y-Z plane.

A drive shaft between the motor output shaft and the blind's control shaft includes a flexible coupling or joint to allow the axis of rotation of the motor output shaft to vary in in a plane parallel to the one containing the blind's control shaft, i.e. the Y-Z plane.

The drive shaft between the motor output shaft and the blind's control shaft includes an extensible joint that allows variation in the length of the motor output shaft.

As shown in U.S. Pat. No. 5,760,558, this enables a relatively small physical device that can be easily installed without tools on virtually any wand-operated venetian blind. However, a driveshaft with the required flexibility and extensibility is relatively difficult to manufacture, and achieving the required degree of flexibility drives the required length of the flexible coupling, in turn increasing the overall size of the controller.

As a result, a subsequent development of the controller disclosed in U.S. Pat. No. 5,760,558 avoided the need for flexibility and extensibility in the coupling by including the required three degrees of freedom in a motor mount referred to commercially as the IntelliDapter™ (and described at www.intelliblinds.com):

The motor mount allows the motor to tilt in the Y-Z plane.

It allows the motor to translate inward and outward along the Y-axis.

It allows the motor to translate upward and downward in the Z-axis.

However, while minimizing the overall size of the controller and avoiding the need for flexibility and extensibility in the drive shaft, the need for two degrees of translation freedom along orthogonal axes results in an assembly that is relatively difficult to manufacture at low cost.

Another limitation of the system disclosed in U.S. Pat. No. 5,760,558, as well as of the aforementioned IntelliDapter™, is that the motor is held in the desired position and/or orientation partly via the coupling between the drive shaft and the blind's control shaft: the drive shaft is attached to the control shaft in such a way that the weight of the motor is partly supported by the control shaft (and, in turn, by the blind's tilter mechanism). The need for such an attachment imposes constraints on the design of the drive shaft and coupler, and the weight of the motor supported by the control shaft can accelerate wear of the tilter mechanism.

Physically Coupling Rotary Motion to Control Shaft 25

The second significant challenge is in physically coupling rotary motion to control shaft 25. This would be straightforward except for two factors:

As previously stated, a successful external motorization device must be able to accurately and repeatably rotate the control shaft of the host blind to predetermined or programmable positions. This requirement imposes an upper limit on the backlash between the motor and control shaft 25.

Referring to FIGS. 2B and 2C, the ID, OD, and thickness T of eye 30 can vary significantly from blind to blind. For example, a survey of blinds in selected U.S. office buildings revealed an ID range of 2.3 mm to 7.0 mm, an OD range of 6 mm to 10 mm, and a thickness range of 1.4 mm to 3.3 mm.

The need to avoid backlash has two implications:

It means that a successful external motorization device must be coupled directly to the control shaft, and not to the wand. Referring to FIG. 1, this is because the coupling between wand 24 and control shaft 25 (which is of the general form of two interlocking rings, and is typical of wand-operated blinds in general) obviously has substantial backlash. This is not an issue for manually operated blinds, but is a major problem for a motorized blind that must be capable of accurately rotating the control shaft to predetermined slat-tilt settings.

For the same reason, an external motorization device cannot use the same type of interlocking-rings type of coupling to couple to the control shaft of the host blind. Instead, the external motorization device must positively engage the control shaft without significant mechanical "slop" or backlash.

Referring again to FIGS. 2B and 2C, the need for positive engagement with the control shaft is what makes the blind-to-blind variation in the ID, OD, and thickness T of eye 30 such a problem in physically coupling an external motorization device to the control shaft of the host blind.

System of U.S. Pat. No. 5,760,558

The embodiments shown in U.S. Pat. No. 5,760,558, as well as the aforementioned IntellDapter™ were intended for use with blinds which have a removable eye clip (e.g. such as eye 30A, of control shaft 25A, shown in FIG. 2D). These systems avoid the problems of backlash and variation in eye size by requiring that the eye of the host blind (e.g. eye 30A) be removed, and then coupling directly to the rod of the control shaft (e.g. rod 25A). The coupling is by means of a coupling tube that telescopes over the rod, and is secured by means of a pin inserted into the hole in the rod which originally accepted the removable eye. The pin provides positive engagement with minimal backlash, even when the inner diameter of the coupling tube is much greater than the outer diameter of the rod of the host blind.

However, this approach is obviously incompatible with blinds that do not have a removable eye. Today, such blinds represent a larger portion of the installed base of blinds than was the case when the system of U.S. Pat. No. 5,760,558 was developed.

Objects and Advantages

It is therefore an object of the invention disclosed herein to provide an external motorized actuator for wand-operated venetian blinds which has all of the advantages of the device disclosed in U.S. Pat. No. 5,760,558, including:

the ability to be easily installed without special tools and without need for removal of, or modifications to, the host blind; and the ability to accurately and repeatably rotate the control shaft of the host blind to predetermined or programmable positions (e.g. fully open or fully closed);

while also providing the following additional advantages:

compatibility with virtually all wand-operated blinds, including those with non-removable eyes (i.e. blinds in which the eye is integral with the control shaft);

avoidance of the need for flexible or extensible joints; and avoidance of the need for a complex physical assembly (e.g. one with machined slots or conventional sliding bearings or joints).

Further objects and advantages will become apparent from a consideration of the drawings and accompanying description.

SUMMARY OF THE INVENTION

The subject invention is an external motorized actuator for wand-operated venetian blinds that incorporates two synergistic innovations:

A motorization system for mounting a motor assembly to a conventional window-blind. The blind has a headrail and a control shaft protruding from the headrail, with the axis of rotation of the control shaft parallel to the side of the headrail. The motor assembly has an output shaft and a first flat surface parallel to the axis of rotation of the output shaft. The motorization system includes a bracket with a second flat surface, a first holding means of holding the bracket to the headrail so that the second flat surface is parallel to the side of the headrail, and a second holding means of holding the first surface of the motor assembly to the second surface of the bracket. The first and second holding means can include, e.g., a magnet (preferred), an adhesive, or a clamp. In use, the first holding means is used to hold the bracket to the headrail and the second holding means is used to hold the motor assembly to the bracket, with the bracket positioned on the headrail, and the motor assembly positioned and oriented on the bracket, so that the output shaft is aligned with the control shaft. The system thus allows rotary motion to be provided from the output shaft to the control shaft about an adjustable axis of rotation, and at an adjustable position, in a plane parallel to the side of the headrail, without need for flexible or extensible shafts, machined slots, or sliding bearings.

A coupler to transfer rotary motion from the output shaft of a motor assembly to the eye of the control shaft of a host blind. The coupler terminates in a structure to engage the eye, and the structure can have either of two configurations:

In a socket configuration, the coupler terminates in a socket having a slot to accept the eye, in roughly the same way that the slot of a screw accepts the tip of a screwdriver. The slot has a cross-section which is tapered radially, or is tapered axially, or is tapered both radially and axially, in a manner described herein, enabling the coupler to engage eyes of various diameters and thicknesses with minimal backlash. In use, the coupler is attached to the output shaft of the motor assembly. The motor assembly is then positioned so that the eye is inserted as far as possible into the coupler's recess, with the axis of the output shaft substantially aligned with the axis of the control shaft, and secured in that position, e.g. via the motorization system of the subject invention.

In a flexible-tab configuration, the coupler terminates in a pair of tabs separated by a slot, with a pin attached to the first tab and extending into a hole in the second tab. The diameter of the pin is no greater than the minimum expected inner diameter of the eye. The tabs can be spread apart, increasing the width of the slot. When the tabs are in the un-spread positon, the width of the slot is no greater than the minimum expected eye thickness of the host blind. The tabs can be spread apart far enough so that the pin is pulled out of the hole in the second tab, leaving a gap between the end of the pin and the second tab, which gap is at least as wide as the maximum expected eye thickness. To engage a host eye, the tabs are spread apart far enough to allow the rim of the host eye to pass between the second tab and the end of the pin, and then the tabs are squeezed together so that the pin passes through the eye and into the second tab, locking the eye in place. One means of squeezing the tabs together is a flexible-but-stiff joint in the base of each tab whose stiffness tends to force the tab into the un-spread position. Another means of squeezing the tabs together is a spring clip that is placed over the tabs, after the eye has been inserted, to press them together. The spring constants of the joints and clip are high enough that the torque required to rotate the eye does not cause the tabs to spread apart far enough to result in excessive backlash. Still another means of squeezing the tabs together is a separate clamping device, e.g. a pair of pliers. In the latter case, the tabs are held together in the squeezed position by friction between the pin and the hole in the second tab, with the friction force being high enough that the torque required to rotate the eye does not cause the tabs to spread apart. The coupler is thus able to positively engage eyes of various thicknesses, inner diameters, and outer diameters with minimal backlash, locks the eye in place via the pin, and can be easily coupled and uncoupled from the host eye.

DESCRIPTION OF DRAWINGS

FIG. 18E is a plan view of the bottom section of socket-configuration 1 according to the subject invention.

NUMBERING CONVENTION

This disclosure uses numerals (e.g. 10) to designate major elements, letter suffixes (e.g. 10A) to indicate sub-elements or portions of major elements, and primes (e.g. 10A', 10") to indicate alternate versions or variations of elements.

LIST OF REFERENCE LETTERS AND VARIABLES

Figure 7:
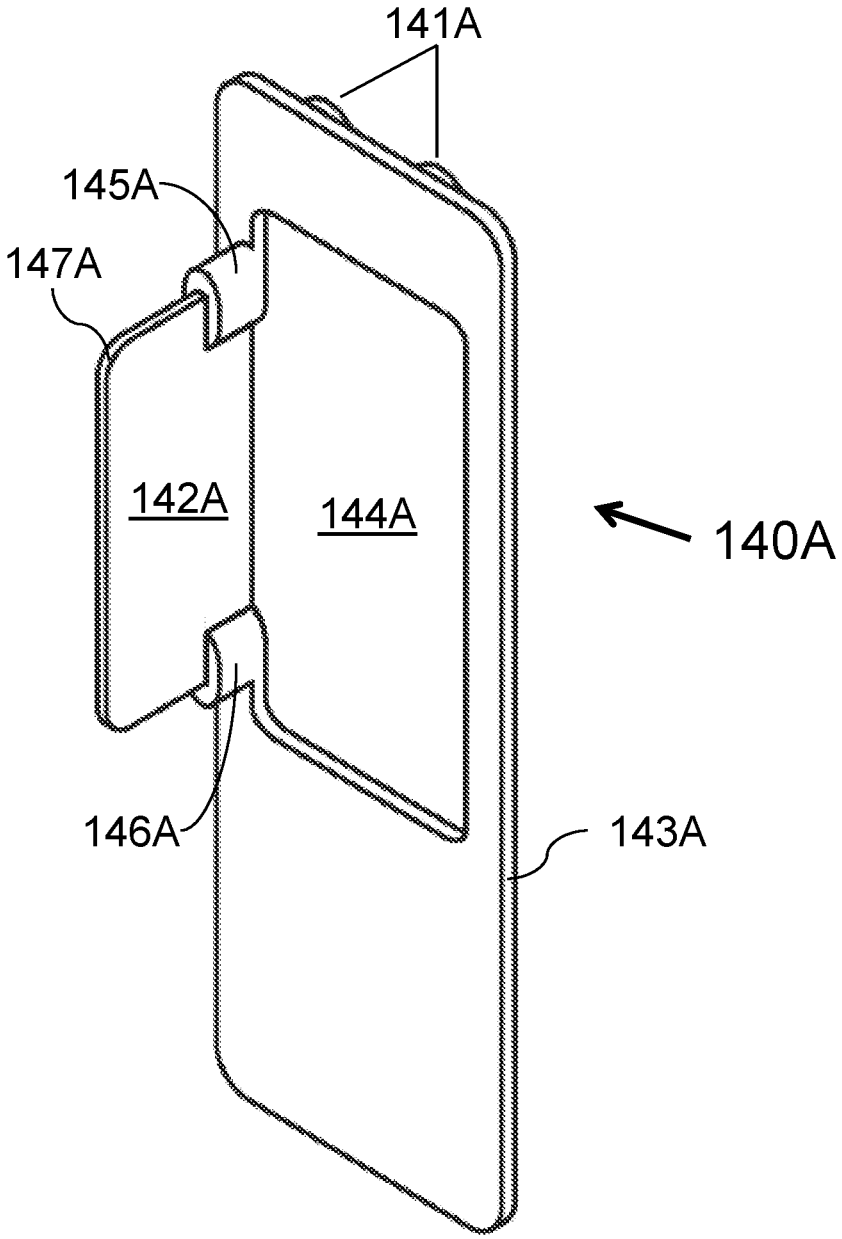
FIG. 7 is an assembled perspective view of a chassis assembly according to the subject invention.

A1 A point representing a combination of eye thickness and eye outer diameter as shown in FIGS. 7 and 9A.

A1O An outline of an eye having the thickness and OD represented by point A1.

A2 A point representing a combination of eye thickness and eye outer diameter as shown in FIGS. 7 and 9A.

A2O An outline of an eye having the thickness and OD represented by point A2.

B1 A point representing a combination of eye thickness and eye outer diameter as shown in FIG. 7.

B1O An outline of an eye having the thickness and OD represented by point B1.

B2 A point representing a combination of eye thickness and eye outer diameter as shown in FIG. 7.

B2O An outline of an eye having the thickness and OD represented by point B2.

C1 A point representing a combination of eye thickness and eye outer diameter as shown in FIG. 9A.

C10 An outline of an eye having the thickness and OD represented by point C1.

C2 A point representing a combination of eye thickness and eye outer diameter as shown in FIG. 9A.

C20 An outline of an eye having the thickness and OD represented by point C2.

D1 A point representing a combination of eye thickness and eye outer diameter as shown in FIG. 9A.

D10 An outline of an eye having the thickness and OD represented by point D1.

D2 A point representing a combination of eye thickness and eye outer diameter as shown in FIG. 9A.

D20 An outline of an eye having the thickness and OD represented by point D2.

Figure 9:
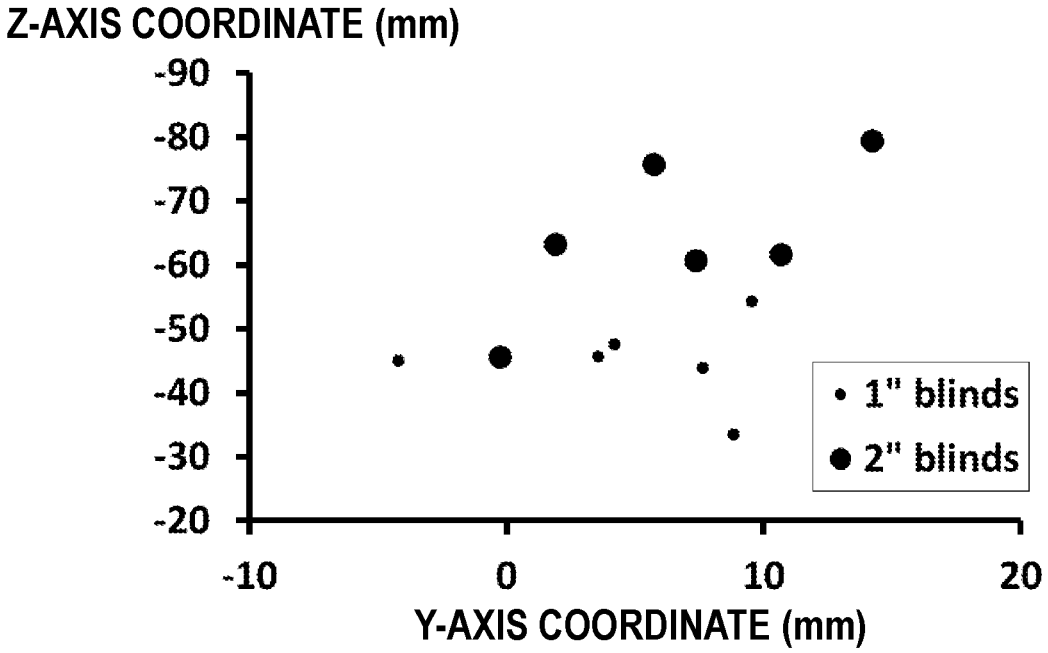
FIG. 9 is a scatter plot of the variation in the Y-Z location of the centers of control-shaft eyes of a random sample of wand-operated blinds in US residential and office buildings.
Figure 10A:
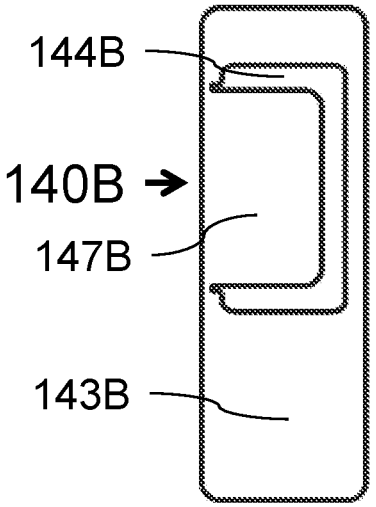
FIG. 10A is a front view of a stamped steel chassis blank according to the subject invention.

E-I Dotted lines on FIG. 10A representing inverse relationships between eye thickness and OD S-A Slot S-A of socket 51" as shown in FIG. 9C.

S-C Slot S-C of socket 51" as shown in FIG. 9C.

S-D Slot S-D of socket 51" as shown in FIG. 9C.

Figure 10B:
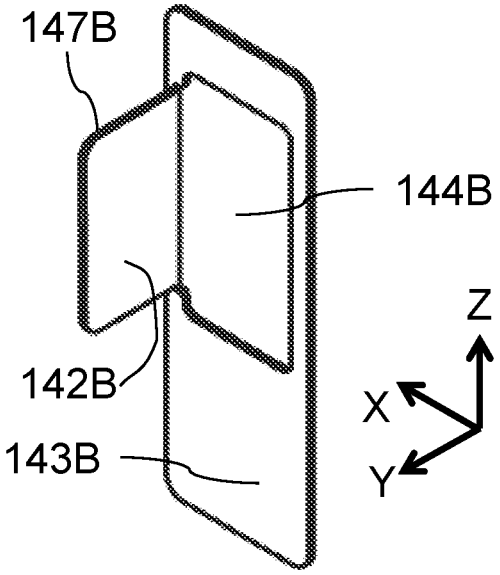
FIG. 10B is a perspective view of a stamped steel chassis according to the subject invention.

S-E Slot S-E of socket 51-A" as shown in FIG. 10B.

S-F Slot S-F of socket 51-A" as shown in FIG. 10B.

S-G Slot S-G of socket 51-B" as shown in FIG. 10B.

S-H Slot S-H of socket 51-B" as shown in FIG. 10B.

S-I Slot S-I of socket 51-B" as shown in FIG. 10B.

Figure 2A:
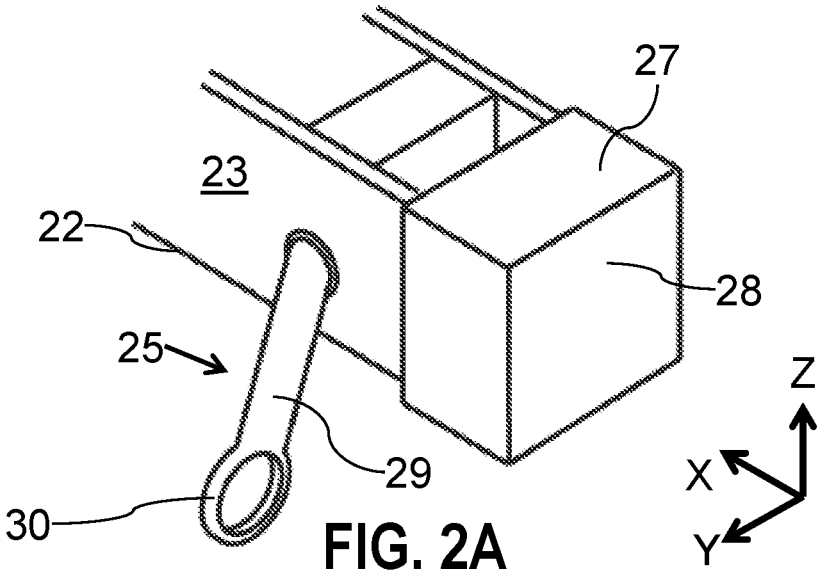
FIG. 2A Prior Art
FIG. 2A (prior art) is a perspective view of a control shaft of a typical wand-operated horizontal blind.
Figure 2B:
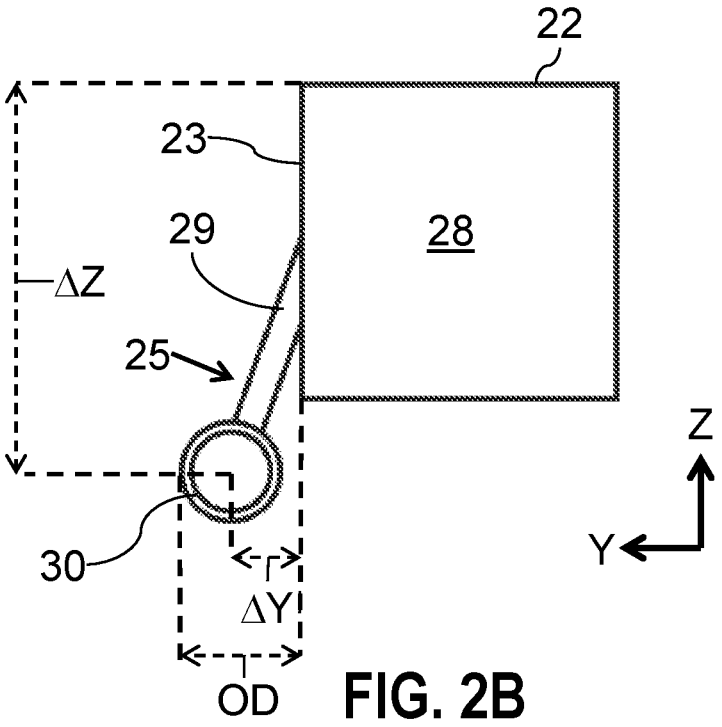
FIG. 2B Prior Art
FIG. 2B (prior art) is a side view of a of control shaft of a typical wand-operated horizontal blind.
Figure 2C:
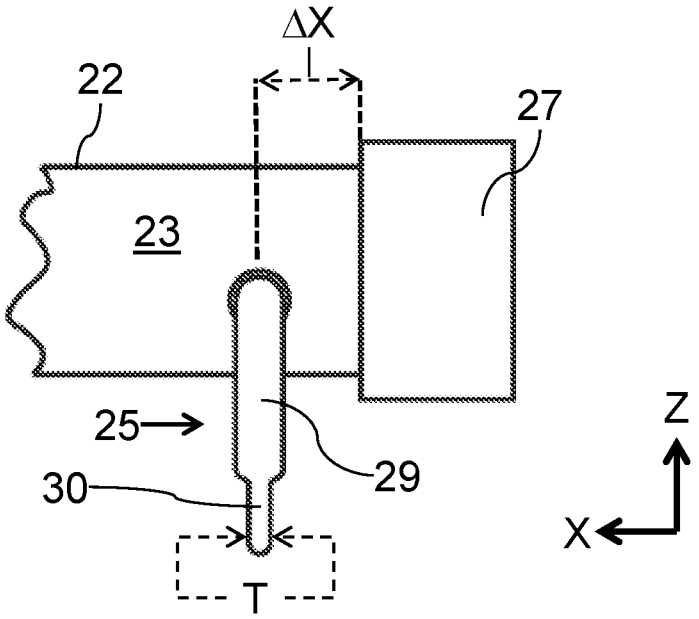
FIG. 2C Prior Art
FIG. 2C (prior art) is a front view of a control shaft of a typical wand-operated horizontal blind.

T Thickness of eye 30, as shown in FIG. 2C

Figure 1:
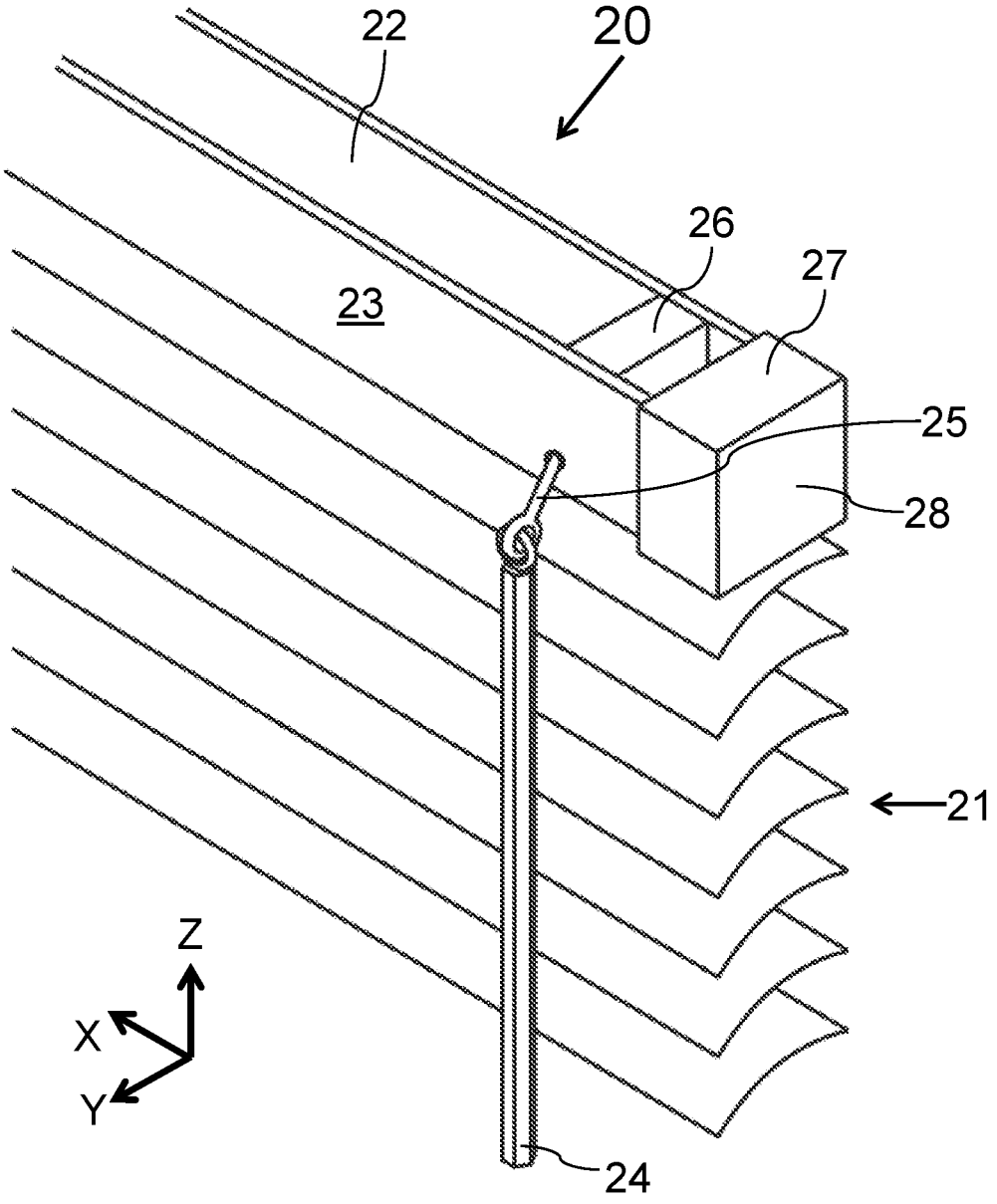
FIG. 1 Prior Art
FIG. 1 (prior art) is a perspective view of a typical wand-operated horizontal blind.

X, Y, Z Axes of the coordinate system shown in FIG. 1

$\Delta X$, $\Delta Y$, $\Delta Z$ Distances along the X, Y, and Z axes, respectively

LIST OF REFERENCE NUMERALS

20 Horizontal venetian blind

21 Slats

22 Headrail

23 Front of headrail

24 Control wand

25 Control shaft

25A Control shaft
25B Control shaft
25C Control shaft
26 Tilter mechanism
27 End bracket
28 Side of end bracket
29 Rod
29A Rod
29B Rod
29C Rod
30 Eye
30A Eye
30B Eye
30C Eye
30AO Eye outline
30BO Eye outline
3000 Eye outline
31A Eye hole
31B Eye hole
31C Eye hole
32A Collar
100 Actuator
110 Motor assembly
110A Motor assembly
110E Motor assembly
111 Motor
111A Motor
112 Surface
112A Surface
113A Motor body
114A Gearbox
115A Output shaft
116A Motor carrier
116B Elastomeric motor carrier
116C Motor carrier incorporating magnet
116D Motor carrier for use with cup-magnet
116D1 Cup magnet receptacle
116D2 Steel cup
116D3 Spacer
117A Rubber strip
118A Magnet
118C Magnet
118D Magnet
120 Coupler
130 Electronics subsystem
131 Controller
132 Power supply
133 User interface
140 Chassis
140A Chassis
140B Chassis
140C Chassis
141 Headrail mount
141A Magnets
142 Surface
142A Surface
142B Surface
143A Chassis plate
143B Chassis blank
143C Chassis plate
144A Cutout
144B Cutout
145A Boss
145C Elastomeric boss
146A Boss
146C Elastomeric boss
147A Ferrous plate
147B Tab
150 Holding means
150A Holding means
160 Compliance means
160A Compliance means
170 Chassis
171 Chassis plate
172 Stanchion
173 Tab
174 Tab
175 Channel
176 Ferrous plate
177 Stanchion
178 Tab
179 Tab
180 Channel
200 Coupler
200A Coupler
201 Socket
201A Socket
201B Socket
201BT Top socket portion
201BB Bottom socket portion
202 Coupler base
202A Coupler base
203 Slot
203A Slot
203B Recess
204 Slot cross-section
204A1 Top cross-section
204B Cross-section
204A2 Middle cross-section
204A3 Middle cross-section
204A4 Bottom cross-section
206 Cross-section with stepped taper
207 Cross-section with curved taper
210 Coupler
211 Coupler base
212 Tab
213 Tab
214 Pin
215 Hole
220 Coupler
220A Coupler
221 Coupler base
222 Tab
222A Tab
223 Tab
223A Tab
224 Pin
224A Pin
225 Hole
225A Hole
226 Clip
227 Leaf
228 Leaf
229 Hole
230L Left pliers tip
230R Right pliers tip
250 PCB List of Special Terms

| TERM | MEANING |
|---|---|
| Axially tapered slot (in coupler) | A slot extending into a coupler along an axis and having a cross-section perpendicular to the axis, the cross-section having a width which decreases with depth into the coupler. |
| Control shaft (of wand-operated blind) | A shaft which protrudes from the headrail of a wand-operated blind, to which a control wand can be attached, whose rotation causes a change in the tilt angle of the slats of the blind. |
| Elastomer, Elastomeric | The words "elastomer" and "elastomeric" are used herein to mean "a material having rubber-like flexibility" and "having rubber-like flexibility", respectively. These meanings are consistent with lay usage of these terms, and are broader than the strict technical definitions (in which "elastomer" means "a polymer exhibiting both viscosity and elasticity", and "elastomeric" means "having both viscosity and elasticity"). |
| Mounting Magnet | A mounting magnet is a conventional magnetic assembly optimized for holding objects to a surface. It consists of a magnet inside an open-faced metal enclosure that redirects the magnetic field from the side opposite the open face toward the open face, thereby increasing the field strength—and hence the pulling force—on that side of the magnet. Two widely-used types of mounting magnet are the cup magnet, which consists of a disc-shaped magnet in a cup-like metal shell, and the channel magnet, which consists of a box-shaped magnet inside a metal channel. |
| Radially tapered slot (in coupler) | A slot extending into a coupler along an axis and having a cross-section perpendicular to the axis, the cross-section having a width which decreases with distance from the center of the cross-section. |

DETAILED DESCRIPTION OF THE INVENTION

The motorized actuator described herein includes two key aspects: a motorization system and a coupler. To facilitate complete understanding of these key aspects and show how they work synergistically in preferred and alternative embodiments of the subject invention, the following description is organized into four sections:

- Major elements of the external motorized actuator.
- Preferred and alternative embodiments of the motorization system.
- Preferred and alternative embodiments of the coupler.
- Synergistic use of motorization system and coupler, including preferred combinations thereof.

Major Elements of Motorized Actuator

This section discusses the major elements of the external motorized actuator in order to provide context for subsequent in-depth discussions of the key aspects and their practical implementation.

Figure 3:
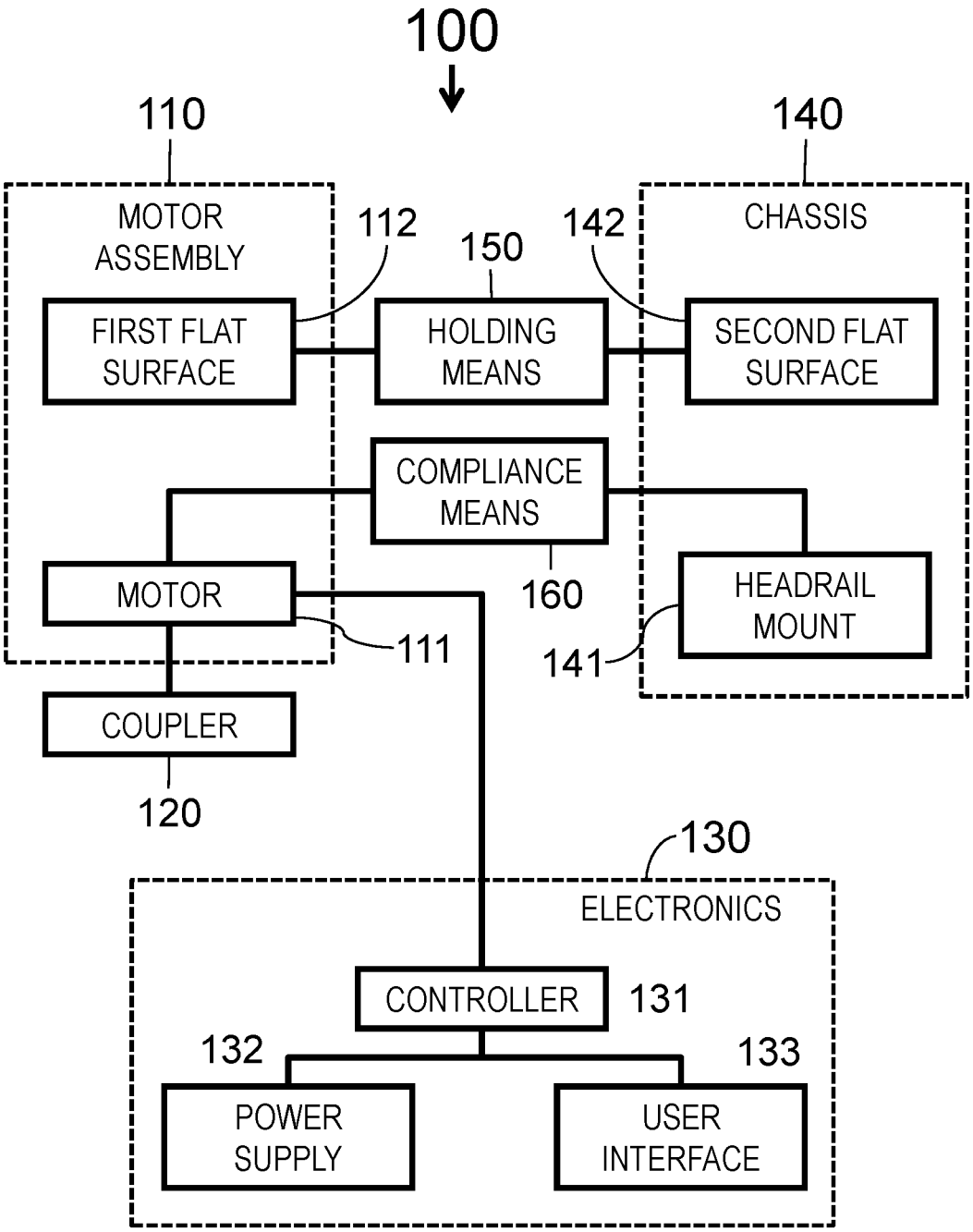
FIG. 3 is a block diagram of an actuator according to the subject invention.

FIG. 3: Block Diagram of Actuator

FIG. 3 is a block diagram of a motorized actuator 100 according to the subject invention. It includes four major elements: a motor assembly 110, a coupler 120, a conventional electronics subsystem 130, a chassis 140, holding means 150, and compliance means 160.

Motor assembly 110 includes a conventional motor 111 (e.g. a permanent-magnet DC gear-motor, a brushless-DC gear-motor, or a stepping motor) with an output shaft that twists with sufficient torque, and rotates with sufficient speed, to actuate the control shaft of a wand-operated venetian blind. Assembly 110 also includes a first flat surface 112 which is a smooth flat surface that may be a part of the housing of motor 111, a surface of a motor carrier into which motor 111 is inserted, or a surface of a bracket which is attached to motor 111. First flat surface 112 is parallel to the output shaft of motor 111.

Coupler 120 is a device to couple rotary motion produced by motor assembly 110 (i.e. rotary motion of the output shaft of motor 111) to the control shaft of a host blind. In most embodiments, the axis of rotation of coupler 120 will be the same as that of the output shaft of motor 111.

Electronics subsystem 130 includes a conventional controller 131, a conventional power supply 132, and a conventional user interface 123. Controller 131 is provides appropriate control and drive signals for motor 111, e.g. to rotate the motor's output shaft to desired positions at desired times or in response to desired stimuli. Controller 131 may include, e.g., a microcontroller and an H-bridge motor driver (or a brushless-DC motor driver, or a stepping-motor driver), and all or portions of controller 131 may be in a separate physical location from actuator 100 (for example, controller 131 could consist of a centralized computer with motor-driver circuitry distributed among many instances of actuator 100). Power supply 132 provides power for the power-consuming portions of actuator 100, and could consist, e.g., of an AC-to-DC converter driven by the AC power mains, a primary battery, or an energy-storage device (e.g. a secondary battery or a super-capacitor) charged by a photovoltaic panel. User interface 133 enables users to control, and optionally monitor the status of, actuator 100. It may include, e.g., a keypad and buzzer, or appropriate hardware and software/firmware to enable a user to interact with actuator 100 via a smartphone app or web-browser.

Chassis 140 provides physical support for the other elements of actuator 100, and includes a headrail mount 141 to enable it (and thereby other elements of actuator 100) to be attached to the headrail of a host blind. Mount 141 could include, e.g., a magnet, and adhesive, or a clamp. Chassis 140 also includes a second flat surface 142 which is a smooth flat surface that is oriented so that, when chassis 140 is mounted on a host headrail, second flat surface 142 is substantially parallel to the side of the host blind's headrail (or, equivalently, parallel to the side of the host blind's end bracket, e.g. side 28 of FIG. 1).

Holding means 150 enables first flat surface 112 of motor assembly 110 to be held to second flat surface 142 of chassis 140 in a desired position and orientation relative to chassis 140. It may include, e.g., a clamp, a magnet, or an adhesive strip, and it may include flat surfaces 112 or 142, or it may be a separate element. For example, first flat surface 112 may be the surface of a magnet attached to motor 111 and second flat surface 142 may be the surface of a steel plate, so that surfaces 112 and 142 together serve as holding means 150.

Compliance means 160 is a means of providing mechanical compliance between motor 111 and the host blind, i.e. to allow the position of motor 111 to move slightly with respect to headrail. Compliance means 160 could be implemented as part of motor assembly 110 or as part of chassis 140. Compliance means 160 could be, e.g., an elastomer or a spring incorporated in motor assembly 110, or it could be an elastomer or spring incorporated in chassis 140.

As noted above, headrail mount 141 and holding means 150 can include, e.g., a magnet, an adhesive, or a clamp. However, for reasons that will be explained subsequently, the use of a magnetic attachment is highly advantageous in both cases, and particularly for holding means 150.

Motorization System Portion of Actuator 100

The motorization system portion of actuator 100 consists of all of the elements shown in FIG. 3 with the exception of coupler 120 and electronics subsystem 130. Specifically, the motorization system consists of motor assembly 110, chassis 140, holding means 150, and compliance means 160.

Preferred and Alternative Embodiments of Motorization System

The preferred embodiment of the motorization system of the subject invention is now described, followed by a discussion of key implementation considerations and alternative embodiments.

Preferred Embodiment of Motorization System

Figure 8:
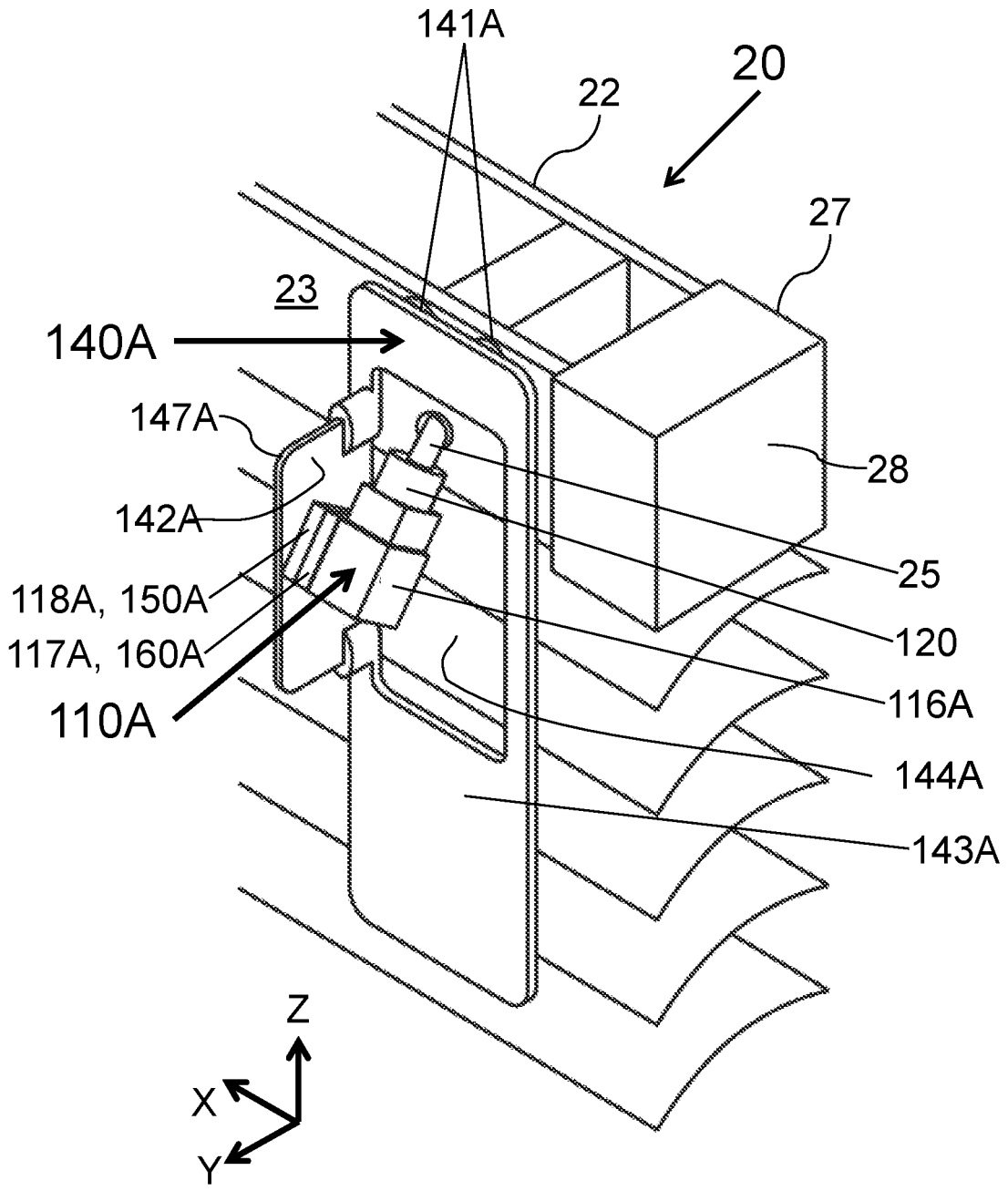
FIG. 8 is a perspective view of a motorization system according to the subject invention mounted on a host blind.

Aspects of the preferred embodiment of the motorization system are shown in FIGS. 4-7, while the complete system is shown in FIG. 8.

Figure 4:
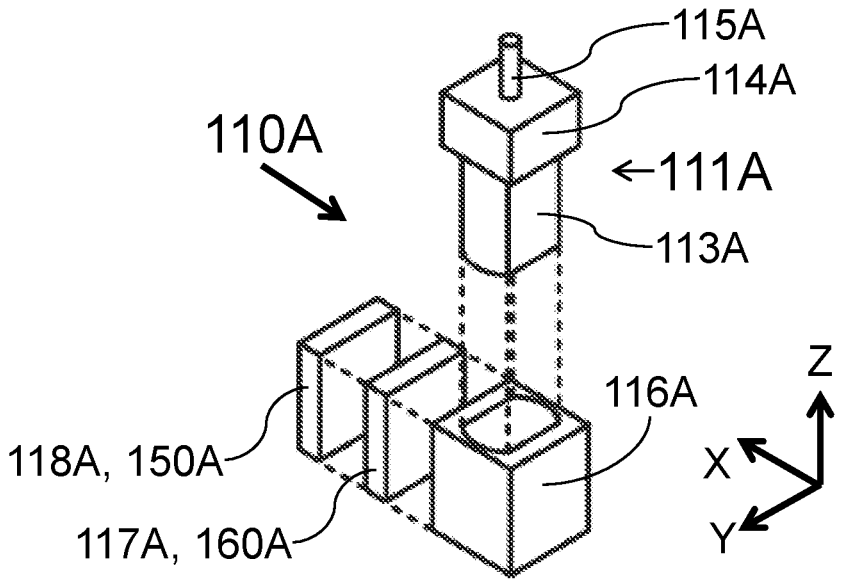
FIG. 4 is an exploded perspective view of a motor assembly according to the subject invention.

FIG. 4: Exploded View of Motor Assembly

FIG. 4 is an exploded perspective view of a preferred embodiment of motor assembly 110, a motor assembly 110A. It also includes the coordinate system of FIG. 1 to facilitate description of dimensions and orientations.

It includes a conventional brushed DC permanent-magnet gear-motor 111A, referred to simply as motor 111A. Motor 111A is of the widely-available N20 type, and consists of a brushed-DC permanent-magnet motor body 113A and a gearbox 114A. Gearbox 114A has an output shaft 115A. Motor 111A also includes power terminals which are not shown.

Motor assembly 110A also includes a motor carrier 116A, which is a block with a hole to accept motor body 113A. In prototypes of assembly 110A, carrier 116A is fabricated of 3D-printed nylon with a maximum wall thickness of about 2 mm; production versions could be, e.g., of injection-molded plastic.

Motor assembly 110A also includes a rubber strip 117A which serves as compliance means 160A (which is an embodiment of compliance means 160 of FIG. 3). Rubber strip 117A has a thickness of about 3 mm and a Shore durometer of 40A. Instead of a separate rubber strip, compliance means 160A could alternatively be incorporated into carrier 116A by fabricating the latter of an elastomeric material.

Motor assembly 110A also includes a magnet 118A which serves as holding means 150A (which, in turn, is one part of an embodiment of holding means 150 of FIG. 3; the other part is a ferrous metal plate described in a subsequent section). Magnet 118A is a small neodymium magnet specified for a pulling force of the order of 30 N, which is more than sufficient to react the torque required to rotate the control shaft of a typical wand-operated venetian blind. It should be noted that placing a magnet of this strength directly against the body of an N20 permanent-magnet gear-motor will cause a perceptible increase in the sound produced by the motor, and could eventually shorten the motor lifetime. However, due to the wall thickness of carrier 116A and the thickness of rubber strip 117A, magnet 118A is far enough away from the body 113A to avoid this issue.

Motor 111A could also include an external encoder assembly (not shown), using Hall-effect or optoelectronic sensors, to provide position or velocity feedback to controller 120. Such an encoder assembly is typically is attached to the end of motor body 113A opposite gearbox 114A. Alternatively, position feedback can be provided to controller 120 using a conventional commutation-pulse sensor to detect the periodic variations in current due to commutation within motor 111A.

If motor 111A does have an external encoder assembly attached to the bottom of body 113A, then carrier 116A would be modified to avoid interference with the encoder, e.g. by removing the side of carrier 116A in the Y-Z plane which is distal to rubber strip 117A. Then, instead of inserting motor 111A into the carrier 116A in the negative-Z direction, the motor would be inserted into the modified carrier in the X-direction and held in place with an adhesive.

Figure 5:
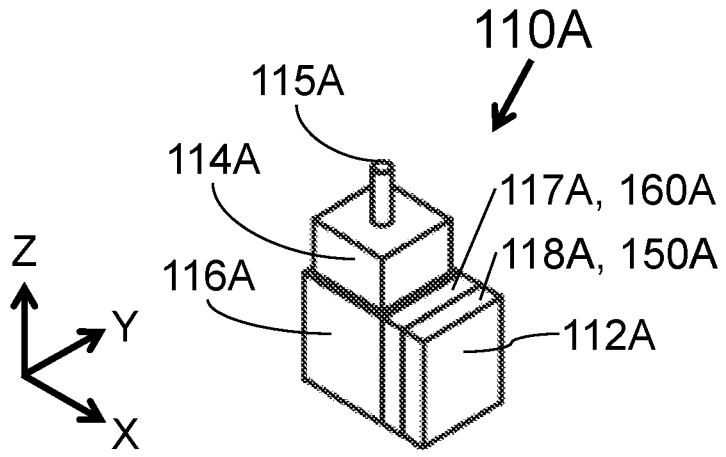
FIG. 5 is an assembled perspective view of a motor assembly according to the subject invention.

FIG. 5: Perspective View of Assembled Motor Assembly

FIG. 4B shows a perspective view of fully-assembled assembly 110A, but—as shown by coordinate system—assembly 110A is rotated 180 degrees about the Z-axis relative to the orientation of FIG. 4A to more clearly show rubber strip 117A and magnet 118A.

Motor 111A is inserted into carrier 116A and secured in place with an adhesive compound. Rubber strip 117A is attached to carrier 116A and magnet 118A is attached to rubber strip 117A. In prototype assemblies, all of these attachments have been made using cyanoacrylate adhesives with a suitable primer.

As evident in the orientation of FIG. 4B, magnet 118A (which also serves as holding means 150A) has a surface 112A which in an embodiment of first surface 112 of FIG. 3. It can be seen that surface 112A is parallel to the axis of rotation of the output shaft of motor 111A, and that rubber strip 117A (which also serves as compliance means 160A) provides mechanical compliance between motor 111A and surface 112A.

Figure 6:
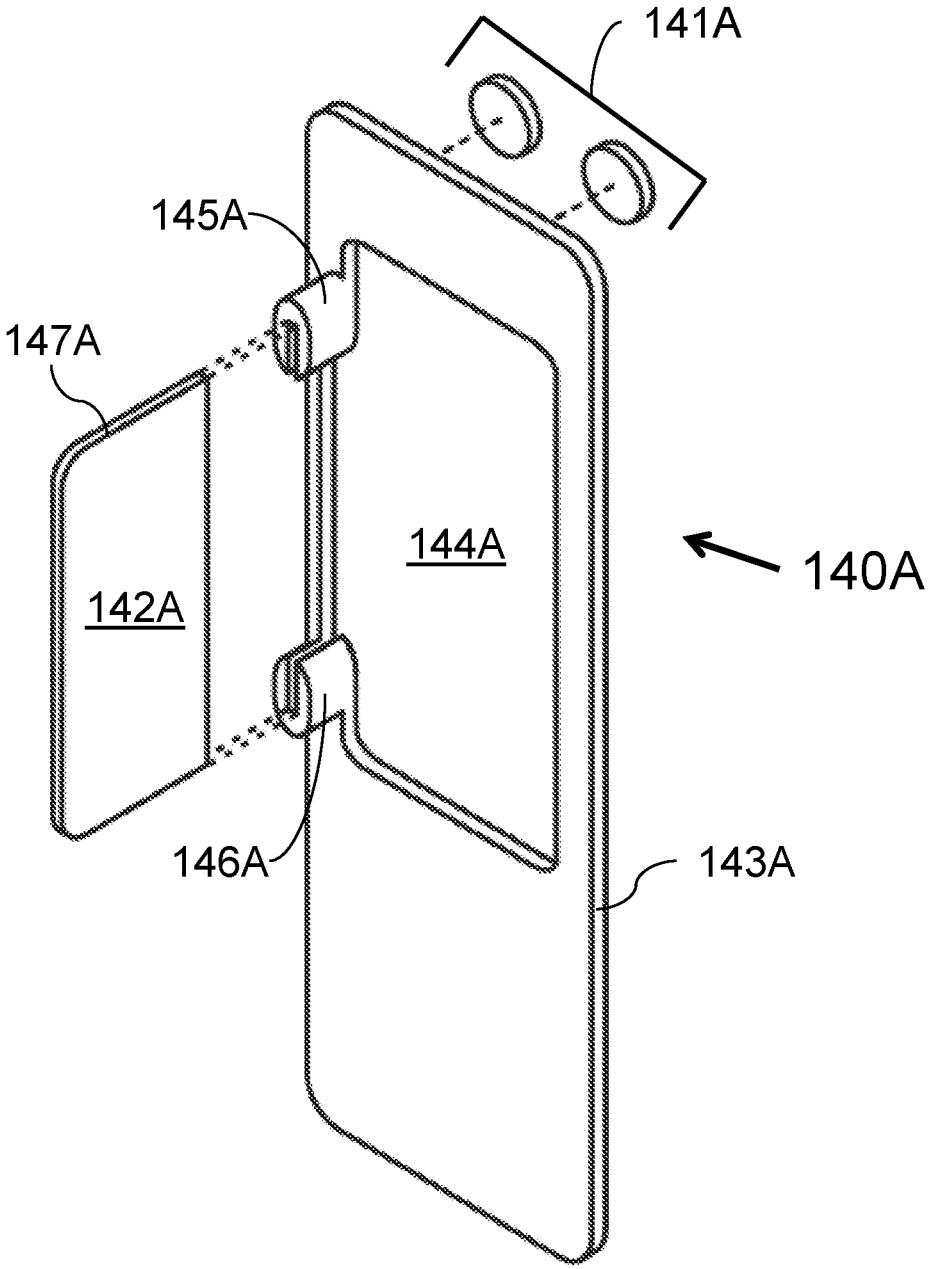
FIG. 6 is an exploded perspective view of a chassis assembly according to the subject invention.

FIG. 6: Exploded Perspective View of Chassis

FIG. 6 is an exploded perspective view of a preferred embodiment of chassis 140, a chassis 140A.

Chassis 140A includes a chassis plate 143A which has a cut-out 144A and slotted bosses 145A and 146A. Prototypes of plate 143A are fabricated of 3D-printed nylon; production versions could advantageously be fabricated using injection molding. The purpose of cut-out 144A will be evident in a subsequent figure.

Bosses 145A and 146A are slotted to accept a ferrous plate 147A. In prototypes of chassis 140A, plate 147A was fabricated of powder-coated steel. Because plate 147A is of ferrous metal, it serves as part of holding means 150 of FIG. 3 (in conjunction with magnet 118A of FIGS. 4 and 5). Plate 147A has a flat surface 142A which serves as an embodiment of second flat surface 142 of FIG. 3.

Chassis 140A includes a pair of magnets 141A, which are an embodiment of headrail mount 141. They serve to secure chassis 140A (and the elements supported by it) to a host headrail. Magnets 141A are of the neodymium type with a specified pulling force of the order of 30 N (each).

In typical embodiments of actuator 100, chassis 140A will also include conventional elements to mount portions of electronics subsystem 130', e.g. mounting bosses for a printed-circuit board. Because these elements are incidental to the essence of the invention, they are omitted for the sake of clarity.

FIG. 7: Perspective View of Assembled Chassis

FIG. 6 is a perspective view of the elements shown in FIG. 6 assembled into chassis 140A. Magnets 141A are attached to plate 143A. In prototypes of chassis 140A, this attachment was made using epoxy glue.

Plate 147A is inserted into the slots in bosses 145A and 146A. Optionally, an adhesive is used to secure plate 140A to the bosses (cyanoacrylate compound was used in prototypes), but press-fitting plate 147A in place would probably be sufficient if plate 147A fits sufficiently tightly in the slots.

FIG. 8: Perspective View of Motorization System on Host Blind

FIG. 8 is a perspective view of the preferred embodiment of the motorization system, consisting of motor assembly 110A and chassis 140A, installed on blind 20. FIG. 8 also shows coupler 120 mounted on motor assembly 110A and coupled to control shaft 25 of blind 20 (via eye 30, which has been inserted into coupler 120 and is therefore not visible FIG. 8).

Chassis 140A is attached to headrail 22 of blind 20 via magnets 141A, which cling to front 23 of headrail 22. It can be seen that surface 142A of plate 147A is parallel to the side (not visible) of headrail 22 and thus to side 28 of end bracket 27. Equivalently, in the context of the coordinate system used herein, surface 142A is in the Y-Z plane.

Magnet 118A of motor assembly 110A clings to surface 142A of plate 147A. Thus, magnet 118A and plate 147A serve as holding means 150A between surface 112A of magnet 118A (not visible in FIG. 8, but visible in FIG. 5) and surface 142A of plate 147A. Thus, magnet 118A and plate 147A together form an instance of holding means 150 of FIG. 3 to hold motor assembly 110A to chassis 140A.

Note that the area of surface 142A is substantially greater than the area of surface 112A (not visible in FIG. 8, but visible in FIG. 5) of magnet 118A. This, coupled with the fact that surfaces 112A and 142A are both in the Y-Z plane and are in sliding contact, allows motor assembly 110A to have an adjustable rotation and position in the Y-Z plane while allowing torque produced by motor assembly 110A to be reacted by headrail 22.

Referring again to FIG. 2B, this allows the orientation and position of motor assembly 110A to be adjusted to accommodate blinds with varying distances AZ and AY between the upper edge of headrail 22 and the center of eye 30. Thus, as shown in FIG. 8 (in which eye 30 is hidden inside coupler 120), motor assembly 110 can thus be rotated and positioned in the Y-Z plane so that the axis of rotation of coupler 120 is aligned with the axis of rotation of control shaft 25 of blind 20. This enables coupler 120 to be coupled to control shaft 25 so that rotary motion from motor assembly 110A can be conveyed to shaft 25.

The purpose of cut-out 144A is now evident: it can be seen that, depending on the design of the host blind, coupler 120 must protrude through cut-out 144A in order to mate with control shaft 25.

Rubber strip 117A provides mechanical compliance between magnet 118A and carrier 116A and thus also serves as compliance means 160A, which is an instance of compliance means 160 of FIG. 3. The purpose of compliance means 160A is to mitigate the effects of any residual misalignment between the axes of rotation of coupler 120 and control shaft 25. Referring to FIG. 5, rubber strip 117A/compliance means 160A achieves this by allowing carrier 110A to move slightly along the X-axis, and to rotate slightly about the Y-axis, with respect to magnet 118A. It also has the undesirable effect of allowing carrier 110A to rotate slightly about the axis of output shaft 111C, which introduces backlash into the system. However, the resulting backlash is too small to adversely affect the utility of the system.

Installation of Motorization system on Host Blind

Still referring to FIG. 8, the process of installing the motorization system on blind 20 is now described (this section does not include a discussion of the process of coupling coupler 120 to control shaft 25, which will be discussed in a subsequent section).

The installation begins by positioning chassis 140 along the X-axis so that it is aligned with control shaft 25, and then allowing magnets 141A to hold chassis 140 to front 23 of headrail 22. Fine adjustments to ensure alignment are made by sliding magnets 141A against front 23 along the X-axis.

Next, motor assembly 110A, which is held against surface 142A of plate 147A by magnet 118A, is rotated and positioned in the Y-Z plane by sliding magnet 118A along surface 142A, so that coupler 120 can be coupled to control shaft 25, with the axis of rotation of coupler 120 aligned with that of control shaft 25. Fine adjustments to ensure alignment of coupler 120 to control shaft 25 are made by sliding magnet 118A along surface 142A.

Thus, installation of the motorization system is easy and quick, requires no tools, and entails no modifications to the host blind. Removal, if required, is equally easy and quick.

Implementation Considerations for Motorization System

Having described the preferred embodiment of the motorization system, key implementation considerations are now discussed to better assist practitioners in implementing this and other embodiments. There are three key considerations in implementing the subject motorization system:

- ability to accommodate variations in the design of the host blind versus visual obtrusiveness;
- ability to tolerate misalignment between the output shaft of the motor assembly and the control shaft of the blind; and
- cost.

Ability to Accommodate Variations in Blind Design Versus Visual Obtrusiveness

While an external motorization system can be much easier to install than one that fits inside the host blind's headrail, it has the potential disadvantage of visual obtrusiveness.

Referring again to FIG. 8, the visual obtrusiveness of the motorization system depends primarily on the size of chassis 140A, which in turn depends to a significant degree on the area of surface 142A: the greater the area, the larger—and, thus, the more visually obtrusive—the system will appear to be.

However, the range of variations in blind design that can be accommodated by the system also depends on the area of surface 142A: the greater the area, the greater the range of control-shaft inclination angle, length, and position (i.e., the greater the variation in the distances AZ and AY of FIG. 2B) that can be accommodated.

Thus, the area of surface 142A represents an important trade-off in the implementation: the larger the area, the greater the range of blind designs that can be accommodated—but also the greater the risk of visual obtrusiveness.

FIG. 9: Variation in Y-Z Location of Center of Eye 30

FIG. 9 shows a scatter-plot of the variation in the Y-Z location of the center of eye 30 as shown in FIG. 2B for a random sample of wand-operated blinds in US residential and office buildings. Based on the sample size, it is believed that virtually all of the blinds currently in use have an eye center location that falls within the ranges of the data of FIG. 9. The points are divided into two groups based on the height of the headrail:

- The points labeled as being associated with 1" blinds are for blinds with headrails that are approximately 1" (25 mm) in height, and are representative of blinds which are widely used in both residential and office buildings.
- The points labeled as being associated with 2" blinds are for blinds with headrails whose heights range from approximately 1.75" (44 mm) to approximately 2.5"

(63 mm), and are representative of blinds which are used mostly in residential buildings, and only rarely in office buildings.

The vertical axis of the plot represents the Z coordinate of the center of eye 30 relative to the top of headrail 22 of FIG. 2B, while the horizontal axis represents the Y coordinate of the center of the eye relative to front 23 of the headrail. The following facts are evident from the plot:

The variation in Z-axis location of the center of the eye is about 20 mm across the sample of 1" blinds, about 35 mm across the sample of 2" blinds, and about 50 mm across both 1" and 2" blinds.

The variation in Y-axis location of the center of the eye is about 15 mm across the sample of 1" blinds, also about 15 mm across the sample of 2" blinds, and about 20 mm across both 1" and 2" blinds.

Thus, if both 1" and 2" blinds are to be accommodated, surface 142A must be about 30 mm taller along the Z-axis and 5 mm deeper along the Y-axis than if only 1" blinds are to be accommodated. Similarly, if only 2" blinds are to be accommodated, then surface 142A must be about 15 mm taller along the Z-axis than if only 1" blinds are to be accommodated.

In considering the implications of this data, it should be noted that actuator 100 will typically include an aesthetically pleasing cover or housing attached to chassis 140A that conceals the components mounted thereon. In testing of prior-art external motorized actuators, it was observed that visual obtrusiveness is correlated more with the depth (i.e. Y-axis extent) and width (i.e. X-axis extent) of the actuator housing than with the height (i.e. Z-axis extent) of the housing. Given this fact, the data of FIG. 9 surprisingly suggest that a design of actuator 100 that accommodates both 1" and 2" blinds will not be prohibitively more obtrusive than one that accommodates only 1" blinds, because accommodating both 1" and 2" blinds entails an increase in Y-axis extent of only 5 mm (the required increase in Z-axis extent, i.e. 30 mm, is much larger but has a relatively minor effect on obtrusiveness).

Thus, the entire installed base of wand-operated blinds (spanning both residential and office buildings) can be effectively addressed with a single actuator design.

Alternatively, if only the office-building market must be addressed, then the data of FIG. 9 can be used to design a minimally-obtrusive version of the actuator intended for only 1" blinds.

Of course, an even smaller and less-obtrusive actuator could be achieved if only a single, specific blind design is to be accommodated.

Ability to Tolerate Misalignments

When installing the motorization system, it will typically be impossible to achieve perfect alignment between the axes of rotation of coupler 120 and control shaft 25. Significant misalignments could cause vibration and possibly binding of (or damage to) components of the motorization system or blind. The purpose of compliance means 160A of FIG. 8 (which is an instance of compliance means 160 of FIG. 3) is to mitigate the effects of misalignments.

However, there are two potential issues with compliance. First, referring to FIG. 3, compliance should not result in movement of chassis 140 relative to the host blind (e.g. as would be the case if compliance were incorporated into headrail mount 141), because such movement could be visible to users of the system. Referring to FIG. 5, rubber strip 117A, which implements compliance means 160A, avoids this problem because the compliance is contained within motor assembly 110A itself, which will typically be hidden behind a housing.

Second, as previously noted, any compliance which allows the motor to rotate about the axis of rotation of its own output shaft will introduce backlash into the system. This compliance-induced backlash will combine with other sources of backlash (e.g. in the tilt mechanism of the blind itself) to yield the total system backlash. Rubber strip 117A, which implements compliance means 160A, does introduce a small but acceptable backlash into the system. Alternatively, more sophisticated forms of compliance can be implemented that do not allow the motor to rotate about the axis of rotation of its output shaft. The issue of backlash is discussed in more detail in subsequent sections of this disclosure.

Cost

Practitioners will, of course, wish to minimize the cost of embodiments of actuator 100. As with any production device, three costs are of interest: tooling costs, materials costs, and fabrication costs, and these costs can be traded to minimize the overall cost for a given production quantity. Practitioners will appreciate that the subject invention enables an exceptionally simple actuator design, and thereby reduces all three costs relative to conventional external motorized actuators.

However, the preferred embodiment of the motorization system shown in FIGS. 4-8 is optimized for minimum cost in small production quantities, and therefore minimizes tooling costs at the expense of increased materials and fabrication costs. In particular, the preferred embodiment of the motorization system is designed so that all of the parts with the exception of plate 140A can be either purchased off-the-shelf or 3D-printed, thereby eliminating tooling costs. The 3D-printed parts (e.g. chassis 140A and carrier 116A) could also be injection-molded, allowing production quantities to be readily scaled. If very high production volumes are intended, then cost could be further reduced as discussed in connection with the alternative embodiments described below.

Alternative Embodiments of Motorization System

Alternative embodiments of the motorization system are now described.

FIGS. 10A and 10B: Stamped Steel Chassis

In the preferred embodiment shown in FIGS. 4-8, chassis 140A is mostly of plastic which can be 3D-printed or injection-molded. If greater tooling costs can be tolerated, then the bulk of the chassis could alternatively be fabricated of stamped sheet steel. Such a stamped steel chassis 140B is shown in FIGS. 10A and 10B. Chassis 140B is formed in two steps:

First, a blanking operation is performed to cut a chassis blank 143B from sheet steel. The resulting chassis blank is shown in FIG. 10A, and has the desired overall outline as well as a cut-out 144B. This blanking operation creates a tab 147B.

Next, a bending operation is formed in which tab 147B is bent 90 degrees to create a surface 142B that is in the Y-Z plane. In this position, tab 140B thus serves the same function as plate 147A of FIG. 8.

This approach the advantage of eliminating the need for a separate ferrous-metal plate, reducing fabrication costs at the expense of additional material costs.

Use of Adhesive Instead of Magnets 141A

A small percentage of headrails are made of plastic or aluminum instead of ferrous metal. If the motorization system is to be used with blinds having such headrails, then headrail mount 141 of FIG. 3 cannot be implemented solely with magnets. In this case, an adhesive could be used instead of, or in addition to, magnets 141A of FIG. 8. Adhesives are also less expensive than neodymium magnets.

In this case, a removable adhesive strip should be used to enable the motorization system to be removed, if desired, after installation.

Referring to FIG. 8, if an adhesive strip or adhesive "dots" are used instead of magnets 141A, then installation is significantly more difficult because chassis 140A cannot be easily repositioned in the X-axis to fine-tune alignment with control shaft 25. This issue can be mitigated by providing a steel strip with an adhesive backing in addition to magnets 141A. The strip can be applied to a plastic or aluminum headrail, enabling magnets 141A to hold chassis 140A in place while also allowing it to be repositioned for precise alignment (by sliding the magnets against the strip) along the X-axis.

Alternative Implementation of Holding Means 150

Instead of magnet 100C' of the preferred embodiment shown in FIGS. 4-8, another implementation of holding means 150 of FIG. 3 could be used to hold first flat surface 112 to second flat surface 142. For example, an adhesive or clamp could be used instead of a magnet, at potentially lower cost.

However, referring again to FIG. 8, magnet 100C' offers a major advantage over alternative holding means: it can be easily repositioned, greatly facilitating alignment of coupler 120 with control shaft 25 and thus significantly streamlining the process of installing the motorization system on the host blind.

This issue is discussed further in the section that addresses use of the motorization system with the coupler of the subject invention.

Figure 11A:
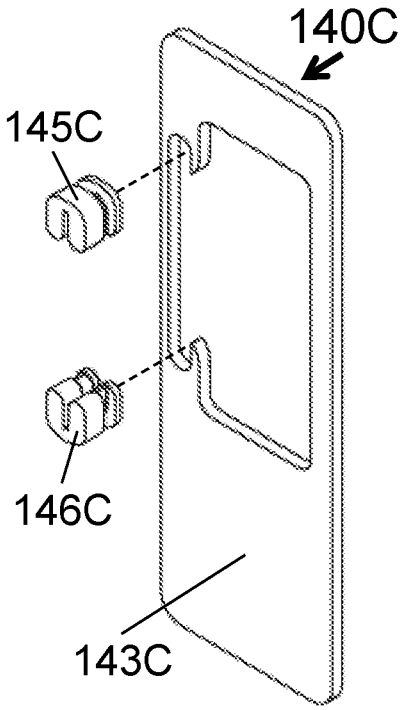
FIG. 11A is an exploded perspective view of a chassis incorporating elastomeric bosses according to the subject invention.
Figure 11B:
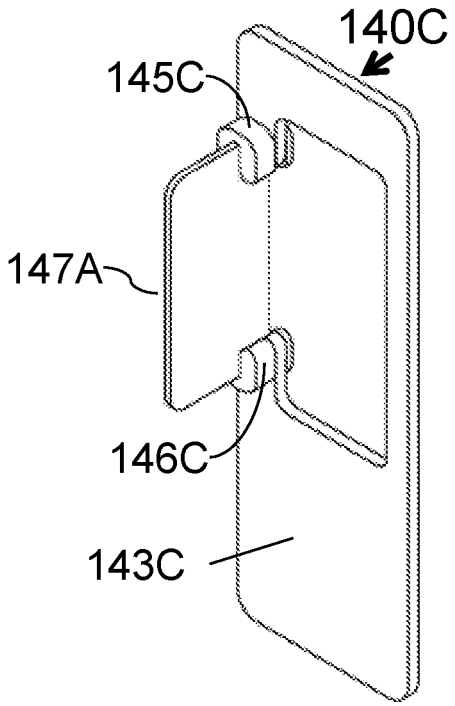
FIG. 11B is an assembled perspective view of a chassis incorporating elastomeric bosses according to the subject invention.

FIGS. 11A and 11B: Plate Secured with Elastomeric Bosses

In the preferred embodiment of the motorization system, plate 147A is inserted into bosses 145A and 146A and secured with a cyanoacrylate adhesive (FIG. 7), while compliance means 160A is implemented as rubber strip 118A (FIG. 8). This minimizes the need for tooling because chassis plate 143A and bosses 145A and 146A can be 3D-printed in one piece.

However, if increased tooling costs are acceptable, a potentially advantageous alternative approach is to secure plate 147A by means of elastomeric bosses. Such an approach is shown in FIGS. 11A and 11B.

FIG. 11A shows a perspective view of a chassis plate 143C and a pair of elastomeric bosses, 145C and 146C. Bosses 145C and 146C are grooved so that each fits into a notch in chassis plate 143C.

FIG. 11B shows bosses 145C and 146C inserted into the notches in plate 143C. Bosses 145C and 146C are slotted to accept ferrous plate 140A of FIGS. 7 and 8. Plate 140A is press-fit into the slots in bosses 145C and 146C and held in place by friction. Bosses 145C and 146C are molded from an elastomeric material that allows plate 140A to move slightly with respect to chassis plate 143C.

Because bosses 145C and 146C are made of an elastomeric material, they serve as an implementation of compliance means 160 of FIG. 3, and therefore eliminate the need for rubber strip 118A of FIGS. 4, 5, and 8. This eliminates one step in the fabrication process, but entails special tooling to mold the elastomeric bosses.

Figure 12A:
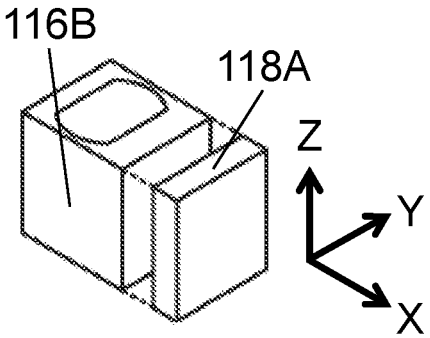
FIG. 12A is a perspective view of an elastomeric motor carrier according to the subject invention.

FIG. 12A: Elastomeric Motor Carrier

Instead of a rubber strip (e.g. rubber strip 118A of FIGS. 4, 5, and 8) or elastomeric bosses (e.g. bosses 145C and 146C of FIGS. 11A and 11B), compliance means 160 of FIG. 3 can be implemented by molding a motor carrier of an elastomeric material. Such a motor carrier 116B is shown in FIG. 12A, along with magnet 118A. It serves the functions of both motor carrier 116A and rubber strip 118A, eliminating the need for the rubber strip but necessitating special tooling for molding carrier 116B.

Figure 12B:
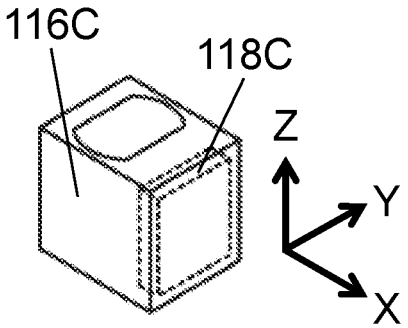
FIG. 12B is a perspective view of a motor carrier with molded-in magnet according to the subject invention.

FIG. 12B: Motor Carrier Incorporating Magnet

Instead of attaching the magnet externally to the motor carrier, it can instead be molded into the carrier, eliminating the need for a separate attachment process. This can be done for both rigid and elastomeric motor carriers.

FIG. 12B shows such a motor carrier, motor carrier 116C, which incorporates a molded-in magnet 118C. Ideally, motor carrier 116C is molded of an elastomeric material.

Referring again to FIG. 8, a motor assembly incorporating elastomeric motor carrier 116C instead of motor carrier 116A has the following disadvantages and advantages:

Carrier 116C has the disadvantage that the wall thickness of the elastomer reduces the pulling force between magnet 118C and plate 147A.

However, despite the reduced pulling force, friction between the elastomeric material and surface 142A of plate 147A can actually increase the ability of a motor assembly incorporating carrier 116C to resist movement in the Y-Z plane (e.g. as might tend to be caused by the weight of the motor assembly).

Such a configuration is advantageous because there will typically be more than enough pulling force between the magnet and the plate to react the motor torque necessary twist a blind's control shaft, so the increased ability to resist movement in the Y-Z plane increases the overall security of the attachment between the motor assembly and the plate.

Figure 12C:
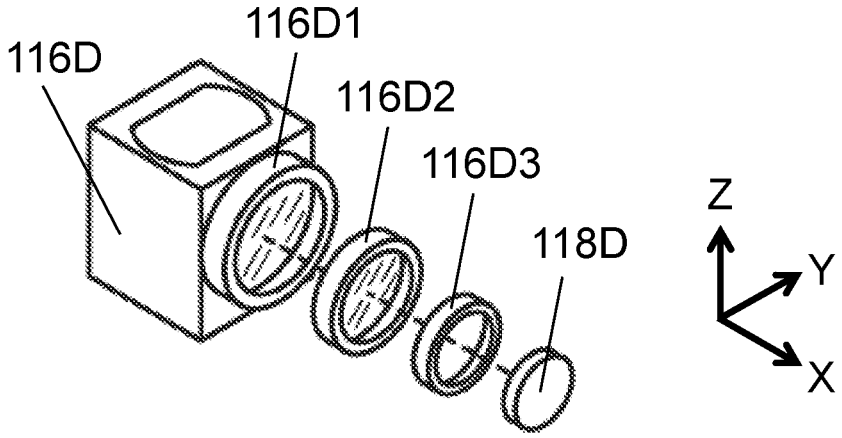
FIG. 12C is an exploded perspective view of a motor carrier incorporating a mounting magnet.
Figure 12D:
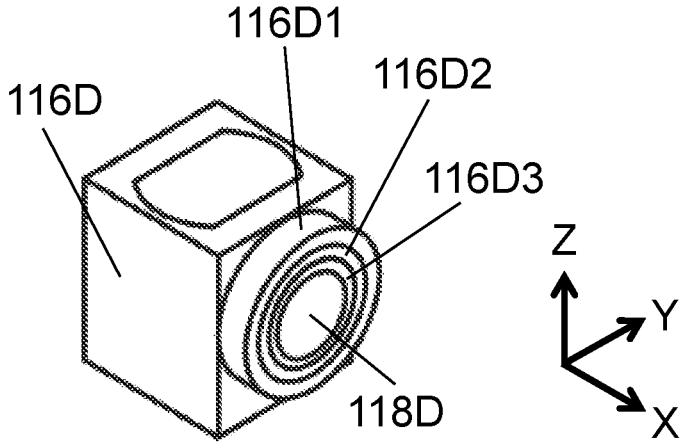
FIG. 12D is an assembled view of a motor carrier incorporating a mounting magnet.

FIGS. 12C and 12D: Motor Carrier with Mounting Magnet

A mounting magnet is a magnetic assembly optimized for holding objects to a surface. It consists of a magnet inside an open-faced metal enclosure (typically in the shape of a cup or a channel) that redirects the magnetic field from the side opposite the open face toward the open face, thereby increasing the field strength—and hence the pulling force—on that side of the magnet. For applications that require a high pulling force, a mounting magnet may be more cost-effective than a larger conventional magnet with the same pulling force.

Referring again to FIG. 4, the pulling force required of magnet 118A will typically not be great enough to justify use of a mounting magnet instead of a conventional magnet. However, use of a mounting magnet in this application can be highly advantageous for another reason: use of a conventional magnet for magnet 118A can result in a magnetic field near motor 111A that is strong enough to disrupt operation of a Hall-effect encoder, which disruption can be avoided if a mounting magnet instead of a conventional magnet. This is not just because the metal structure of a mounting magnet redirects the magnetic field, but also because a smaller magnet can be used to achieve the required pulling force. This is a potentially significant advantage because Hall-effect encoders are a widely-used, cost-effective sensor means for closed-loop motor control.

A cup magnet is a widely-used form of mounting magnet. FIGS. 12C and 12D show exploded and assembled views, respectively, of a motor carrier 116D incorporating such a conventional cup magnet assembly, which consists of a magnet 118D nested inside a steel cup 116D2, with a spacer 116D3 used to center magnet 118D inside cup 116D2 in the Y-Z plane. The cup magnet assembly comprising magnet 118D, spacer 116D3, and cup 116D2 is, in turn, nested inside a cup magnet receptacle 116D1 which is attached to carrier 116D.

In a preferred embodiment of such a motor carrier, receptacle 116D1 and carrier 116D are 3D-printed or injection-molded together in one piece of nylon. Cup 116D2 is secured inside receptacle 116D1, and spacer 116D3 is secured inside cup 116D2, with a cyanoacrylate adhesive. Magnet 118D is also secured inside spacer 116D3 and to cup 116D2 with a cyanoacrylate adhesive.

Alternatively, a screw could be used to secure the parts together. In this case, Magnet 118D would have an axial counter-sunk hole to accommodate the head of a screw; cup 116D2 would have a clearance hole to pass the screw, and receptacle 116D1 would have a threaded hole to engage the screw.

Alternatively, another-type of mounting magnet could be used instead of a cup magnet. For example, a channel-type of mounting magnet, consisting of a box-shaped magnet inside a steel channel, could be used.

As is the case with the other motor carrier embodiments shown herein, receptacle 116D1 and carrier 116D could be of an elastomeric material to provide compliance.

The use of a mounting-magnet, such as the cup magnet of FIGS. 12C and 12D, would result in a slightly more complex and expensive assembly relative to use of a simple magnet (e.g. as shown in FIGS. 12A and 12B). However, this is the preferred way to implement holding means 150 of FIG. 1 for embodiments of actuator 100 which include a Hall-effect encoder for motor control. If a mounting magnet such as depicted in FIGS. 12C and 12D is not used in such embodiments, then another means of magnetic shielding (e.g. a steel can around for the Hall-effect encoder) would likely be necessary. Alternatively, the distance between the magnet and the Hall-effect encoder could be increased to reduce the field strength at the encoder, but this would result in an excessively large assembly.

FIGS. 13-15B: Compliance Means Incorporated Into Chassis

Instead of separate rubber or elastomeric components, compliance means 160 of FIG. 3 can be implemented by deliberately designing flexibility into chassis 140. This can be done, e.g., by fabricating the chassis of a material such as nylon, and including design features such as "living hinges" to provide flexibility at selected points, and around selected axes, in the chassis structure.

Such a chassis, chassis 170, is shown in FIGS. 13-15B.

Figure 13:
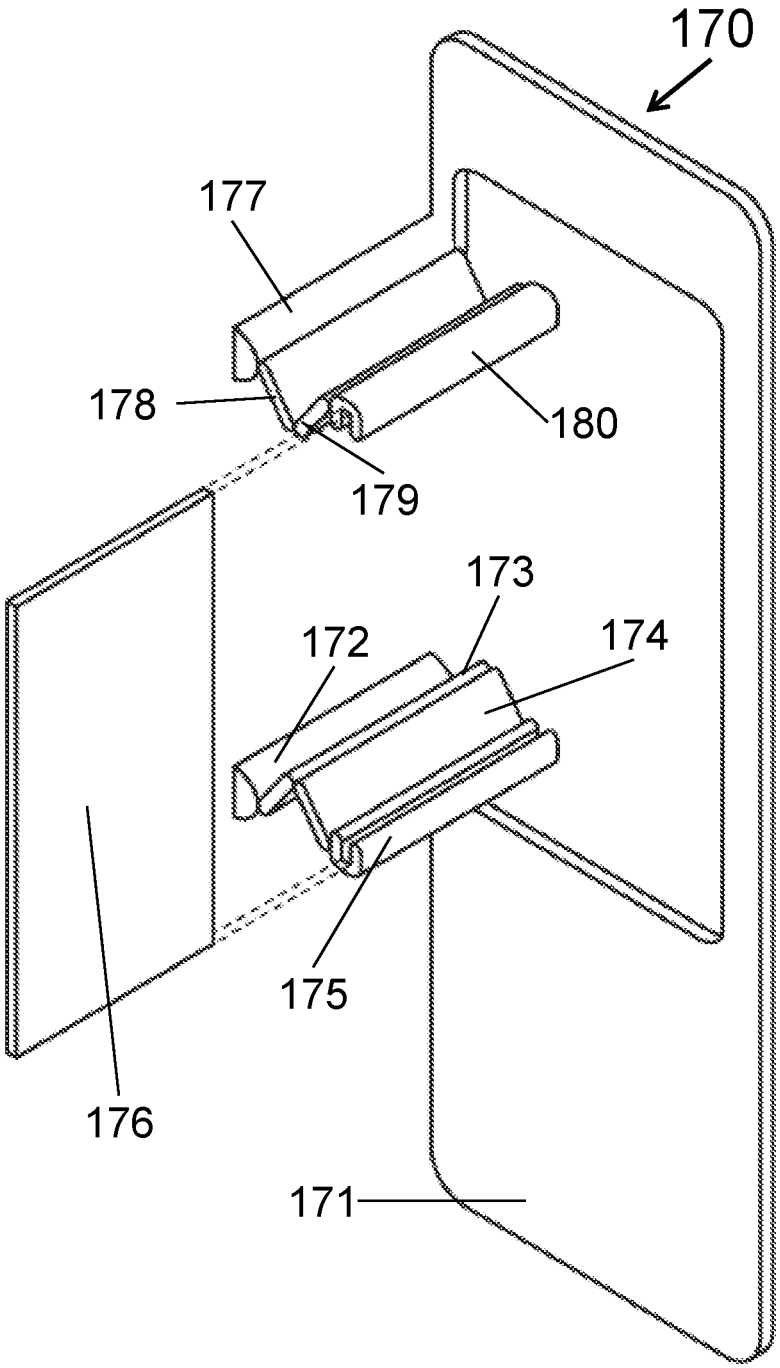
FIG. 13 is an exploded perspective view of a chassis incorporating living-hinge compliance according to the subject invention.
Figure 14:
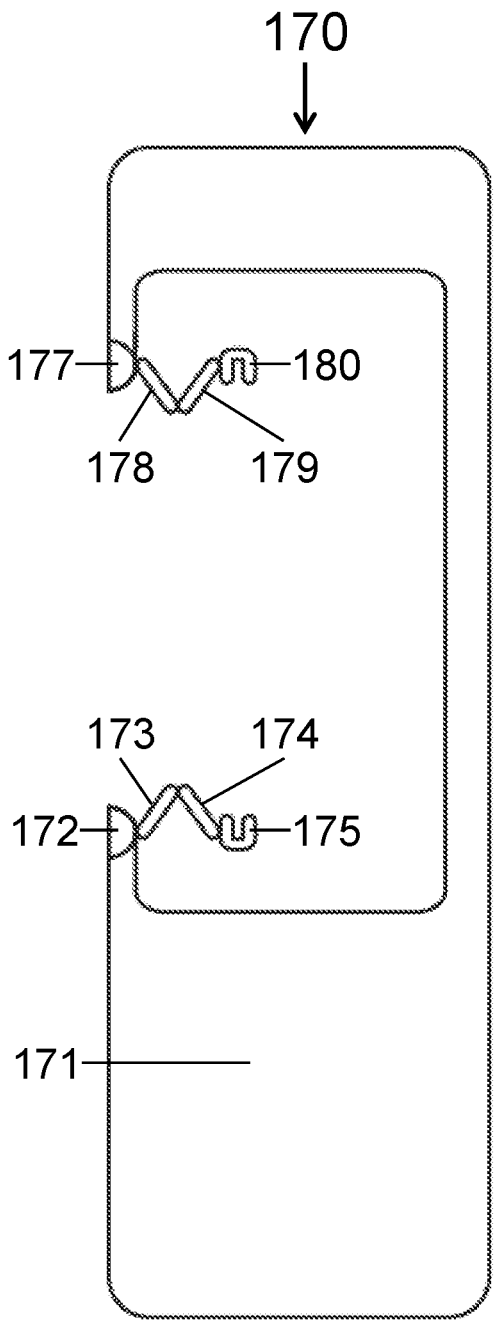
FIG. 14 is a front view of a chassis incorporating living-hinge compliance according to the subject invention.

Referring to FIG. 13 (perspective view) and 14 (front view), chassis 170 consists of a chassis plate 171 with a pair of double-hinged structures, a top structure and a bottom structure. In practice, chassis 170 would also include an embodiment of headrail mount 141 of FIG. 3, such as a pair of magnets similar to magnets 141A of FIG. 6. Chassis 170 is fabricated of a plastic such as nylon, either via 3D-printing or injection-molding.

The top structure consists of a stanchion 177, tabs 178 and 179, and a channel 180. Stanchion 177 projects from chassis plate 171. Channel 180 has a lengthwise slot. Channel 180 is attached to tab 179 via a "living hinge", i.e. a thinner section of material that provides a flexure bearing. Similarly, tab 179 is attached to tab 178 via a living hinge, and tab 178 is attached to stanchion 177 via a living hinge.

The bottom structure is identical to the top structure, consisting of a stanchion 172, tabs 173 and 174, and a channel 175. As with the top structure, the attachments between these elements are via living hinges.

The lengthwise slots in channels 180 and 175 accommodate a ferrous plate 176 (shown in FIG. 13 but not in FIG. 14), which is inserted into the slots and secured using a cyanoacrylate adhesive.

Figure 15A:
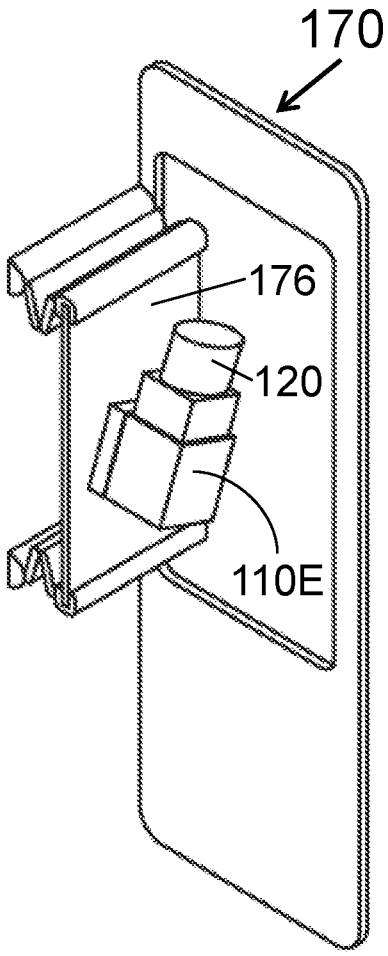
FIG. 15A is a perspective view of a chassis incorporating living-hinge compliance according to the subject invention in the contracted position.
Figure 15B:
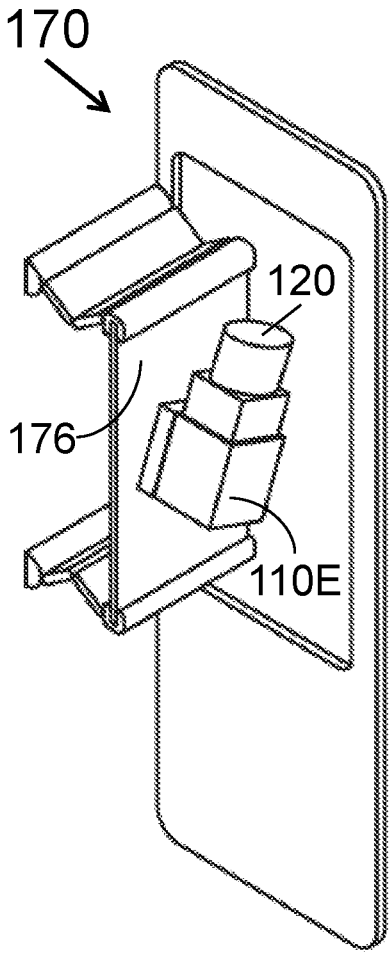
FIG. 15B is a perspective view of a chassis incorporating living-hinge compliance according to the subject invention in the extended position.

FIGS. 15A and 15B are perspective views of chassis 170 with ferrous plate 176 secured in position, and also showing a motor assembly 110E and coupler 120. Motor assembly 110E is identical to motor assembly 110A of FIGS. 4 and 5, except that it omits rubber strip 117A, which is not required because compliance means 160 is incorporated into chassis 170. Referring again to FIG. 13, the compliance is achieved by means of the three living hinges in the top structure consisting of elements 177—70T4, and the three living hinges in the bottom structure consisting of elements 172—175. These living hinges allow the top and bottom structures to expand and contract laterally, allowing plate 170 to move back and forth. This is shown in FIGS. 15A and 15B: FIG. 15A shows the structures in the contracted position, while FIG. 15B shows the structures in the expanded position. This lateral compliance mitigates the effects of any lateral misalignments between coupler 120 and the host blind's tilt-control shaft.

An advantage of chassis 170 is that, while it provides compliance that allows lateral movement of plate 176, it does not provide compliance in any other dimension, and in particular is resistant to flexure due to torque produced by motor assembly 110E. Thus, unlike the other compliance means described herein, the compliance provided by chassis 170 does not contribute to backlash between the motor and the control shaft of the host blind. Further, chassis 170 can be easily 3D-printed. However, if fabricated instead via injection-molding, the living-hinge structures of chassis 170 substantially increase the complexity of the required mold.

Preferred and Alternative Embodiments of Coupler

The purpose of the coupler disclosed herein is to transfer rotary motion from the output shaft of a motor assembly to the eye of the control shaft of a host blind, in a manner characterized by three attributes:

- ease of installation;
- compact size;
- minimal backlash; and
- ability to accommodate the variations in eye design among wand-operated blinds.

Beyond transferring rotary motion, the coupler can optionally also provide a secure attachment between the output shaft and the eye of the control shaft, e.g. in order to help secure the motor assembly to the host blind.

The coupler disclosed herein was enabled by the discovery of certain aspects of the variation in eye design among wand-operated blinds.

Figure 16:
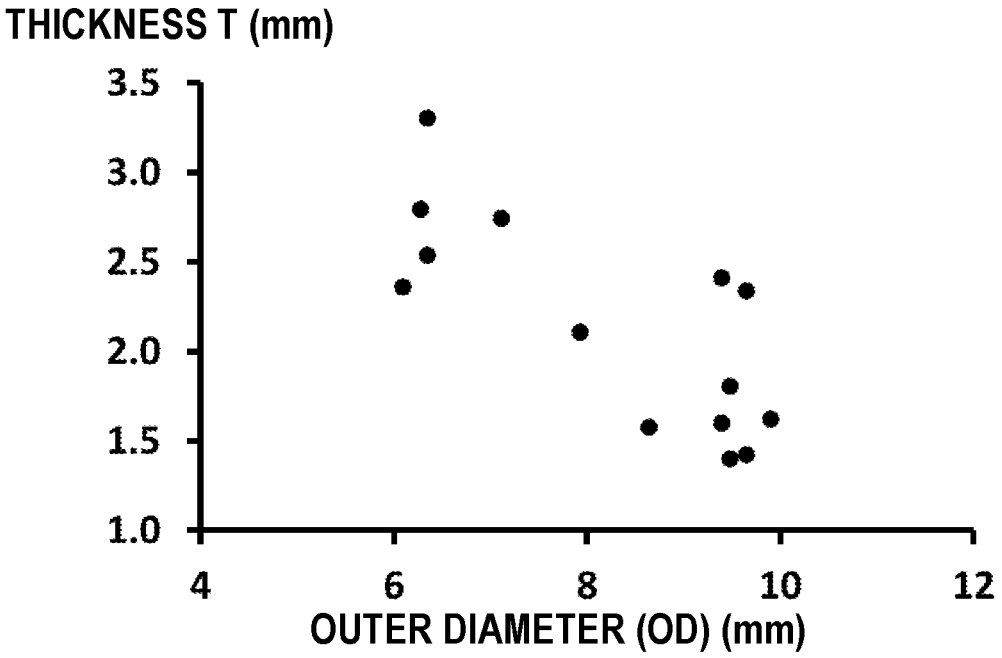
FIG. 16 is a scatter plot of the variation in the thickness versus outer diameter (OD) of the control-shaft eyes of a random sample of wand-operated blinds in US residential and office buildings.

FIG. 16: Eye Thickness Versus Eye Outer Diameter

FIG. 16 is a scatter plot showing eye thickness (e.g. the thickness T of eye 30 shown in FIG. 2C) versus eye outer diameter (e.g. the outer diameter OD of eye 30 shown in FIG. 2B) for a random sample of wand-operated blinds in US residential and office buildings. Based on the sample size, it is believed that virtually all of the blinds currently in use have eye thickness and ODs that fall within the ranges of the data of FIG. 16. No correlation was observed between headrail height and either eye OD or eye thickness, so unlike the data points of FIG. 9, the data points of FIG. 5 are not grouped according to headrail height.

The plot of FIG. 16 reveals the following facts which are not generally recognized in the art:

- There is an inverse correlation between eye thickness T and OD.
- The variation in thickness T is only about 2 mm.

The subject invention exploits these facts via two different coupler configurations: a "socket" configuration which maximizes ease of installation, and a "flexible tab" configuration which trades some ease of installation for a secure attachment to the host blind's control shaft. Both of these configurations work synergistically with the motorization system described above in order to enable the objects and advantages of the subject invention.

Figure 17A:
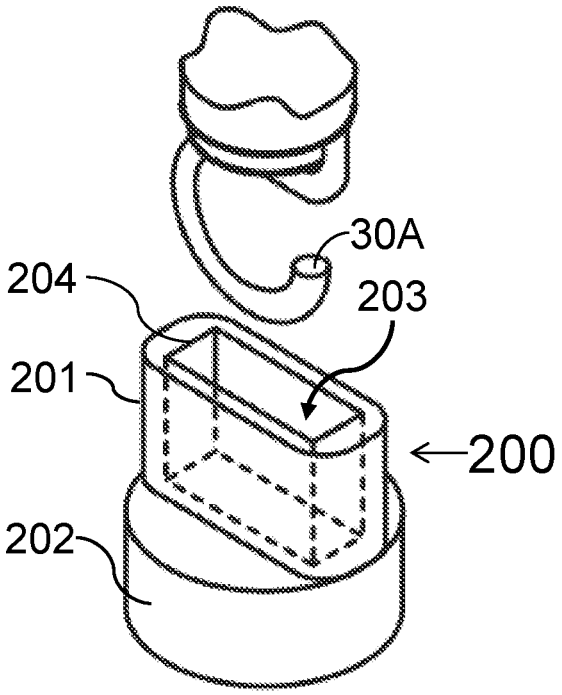
FIG. 17A is a perspective view of an ordinary socket-configuration coupler and host eye.
Figure 17B:
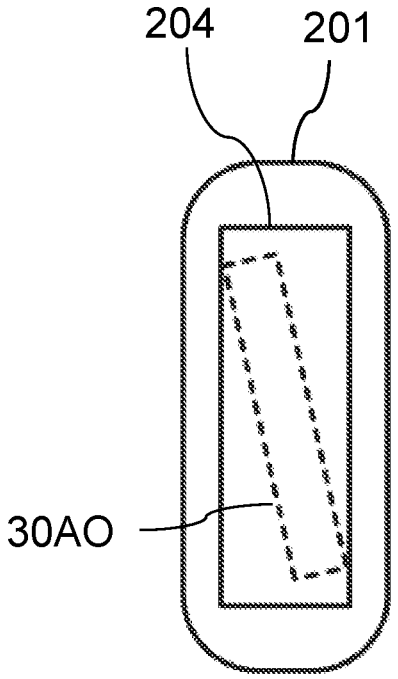
FIG. 17B is a plan view of an ordinary socket-configuration coupler, also showing the rotated outline of a relatively small host eye to illustrate the resulting backlash.

FIGS. 17A and 17B: Ordinary Socket Configuration and Attendant Backlash

Before describing the innovative socket configuration and the advantages thereof, an ordinary socket configuration—and its limitations—are first discussed.

Figure 2D:
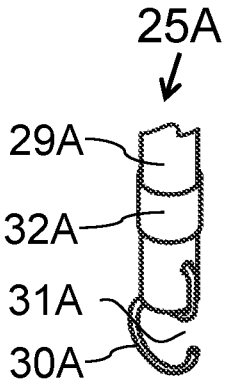
FIG. 2D Prior Art
FIG. 2D (prior art) is a perspective view of a first type of control shaft configuration.
Figure 2E:
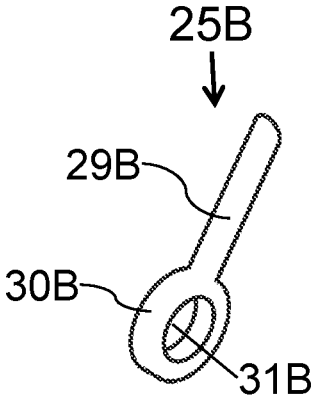
FIG. 2E Prior Art
FIG. 2E (prior art) is a perspective view of a second type of control shaft configuration.
Figure 2F:
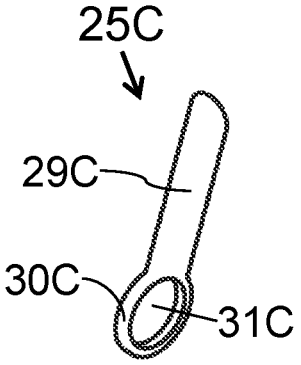
FIG. 2F Prior Art
FIG. 2F (prior art) is a perspective view of a third type of control shaft configuration.

FIG. 17A is a perspective view of an ordinary coupler 200, consisting of a socket 201 and a coupler base 202, to engage eye 30A of a host blind. Eye 30A, previously shown in FIG. 2D, is one of the smaller eyes whose dimensions are depicted in FIG. 16, specifically the eye with a thickness of about 1.4 mm and an OD of about 8.5 mm.

Socket 201 has a slot 203 in its upper face, and slot 203 has a rectangular cross-section 204. In use, coupler base 202 would be attached to the output shaft of a motor assembly, and the motor assembly—along with coupler 200—would be positioned and secured so that eye 30A is inserted into slot 203, thereby enabling rotary motion to be transferred from the motor assembly, via coupler 200, to eye 30A.

Referring again to FIG. 16, the maximum eye thickness and eye OD of the sampled blinds are about 3.3 mm and 10 mm, respectively. Thus, in order to accommodate all of the eyes whose dimensions are depicted on FIG. 16, cross-section 204 of socket 201 must be at least 3.3 mm by 10 mm. In order to ensure secure coupling between the eye and the socket, the depth of slot 203 should be a substantial fraction (e.g. one-half) of the largest expected eye OD, i.e. about 5 mm for a 10 mm eye.

FIG. 17B is a plan view of socket 201 and cross-section 204. Also shown is an outline 30AO of eye 30A. Outline 30AO is depicted as being rotated with respect to cross-section 204, which represents the backlash that can be expected in transferring rotary motion from socket 201 to eye 30A due to the fact that the eye outline is smaller than the cross-section. The angular displacement of outline 30AO relative to cross-section 204 represents a backlash of about 13.5 degrees. Thus, if socket 201 were being used to transfer motion to an eye with the outside dimensions of outline 30AO, then socket 201 could rotate 13.5 degrees in each direction—for a total "deadband" of 27 degrees—without causing the eye to rotate.

Maximum Acceptable Backlash

As previously stated, backlash is not an issue for manually operated blinds, but can be a significant issue for motorized blinds, for two reasons.

First, depending on the speed of the motor, backlash can a perceptible delay between manual initiation of motor operation and actual movement of the slats. This delay can be annoying and can create the perception of poor quality of the motorization system.

Second, backlash can degrade the operation of automated blinds that do not have a slat-tilt sensor (which can be unsightly or difficult to install), and which therefore must use "dead-reckoning" to adjust the slats to predetermined tilt angles. In systems that use dead-reckoning, backlash causes an error between the dead-reckoned slat-tilt angle (based on angular displacement of the blind's control shaft) and the actual slat-tilt angle.

The net backlash in an external motorization device for a wand-operated blind includes not just the backlash between a coupler (e.g. coupler 200) and the eye of the blind (e.g. eye 30A), but also any inherent backlash in the blind's tilter mechanism (e.g. mechanism 26 of FIG. 1), which is typically of the order of 10 degrees, as well as any backlash in the motorization system (e.g. due to rubber strip 117A of FIG. 8). These sources of backlash are additive.

Any backlash in the tilter mechanism is unavoidable without changing the mechanism, while—as previously discussed—some backlash in the motorization system may be an unavoidable consequence of adding compliance to mitigate the effects of misalignments. For these reasons, it is highly desirable to minimize backlash in the coupler. Development of the subject coupler suggests that coupler backlash should be held to substantially less than 10 degrees in order to avoid negatively affecting system operation. On the other hand, providing multiple sizes of a coupler such as coupler 200 (to provide a closer fit to different sizes of eye) is disadvantageous because it requires the coupler to be removable from the motor output shaft (increasing cost), while also adding another step to the installation process.

FIGS. 18A-18F: Preferred Socket Configuration 1

The innovative socket configuration of the subject invention mitigates backlash, while still preserving compatibility with eyes of various dimensions, by exploiting the surprising fact that there is an inverse correlation between the thickness T and the OD of the eyes of wand-operated blinds. This is achieved by engaging the eye of the host blind with a slot which has a cross-section that is tapered either axially or radially, or both axially and radially.

Figure 18A:
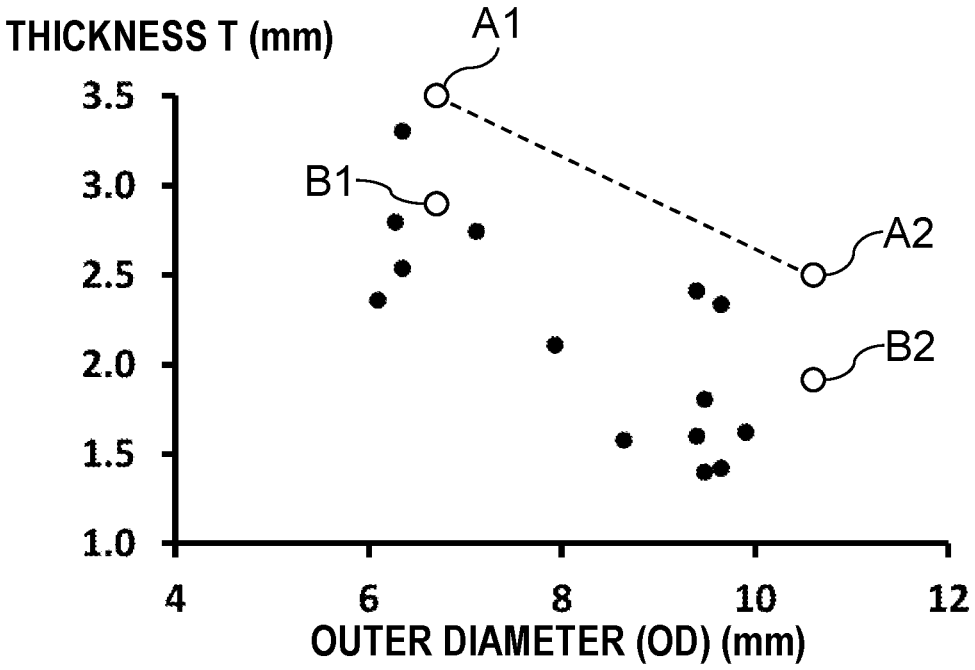
FIG. 18A shows the same scatter plot of FIG. 16 with selected thickness/OD combinations.

FIG. 18A: Eye Thickness Versus Eye OD and Selected Thickness/OD Combinations FIG. 15 shows the same eye thickness-versus-diameter plot of FIG. 16, but with four labeled points, A1, A2, B1, and B2, each of which represents a specific combination of eye thickness and eye OD. The dotted line between A1 and A2 represents an inverse relationship between eye thickness and eye OD; a similar dotted line between B1 and B2 is implied but not shown for the sake of clarity.

Figure 18B:
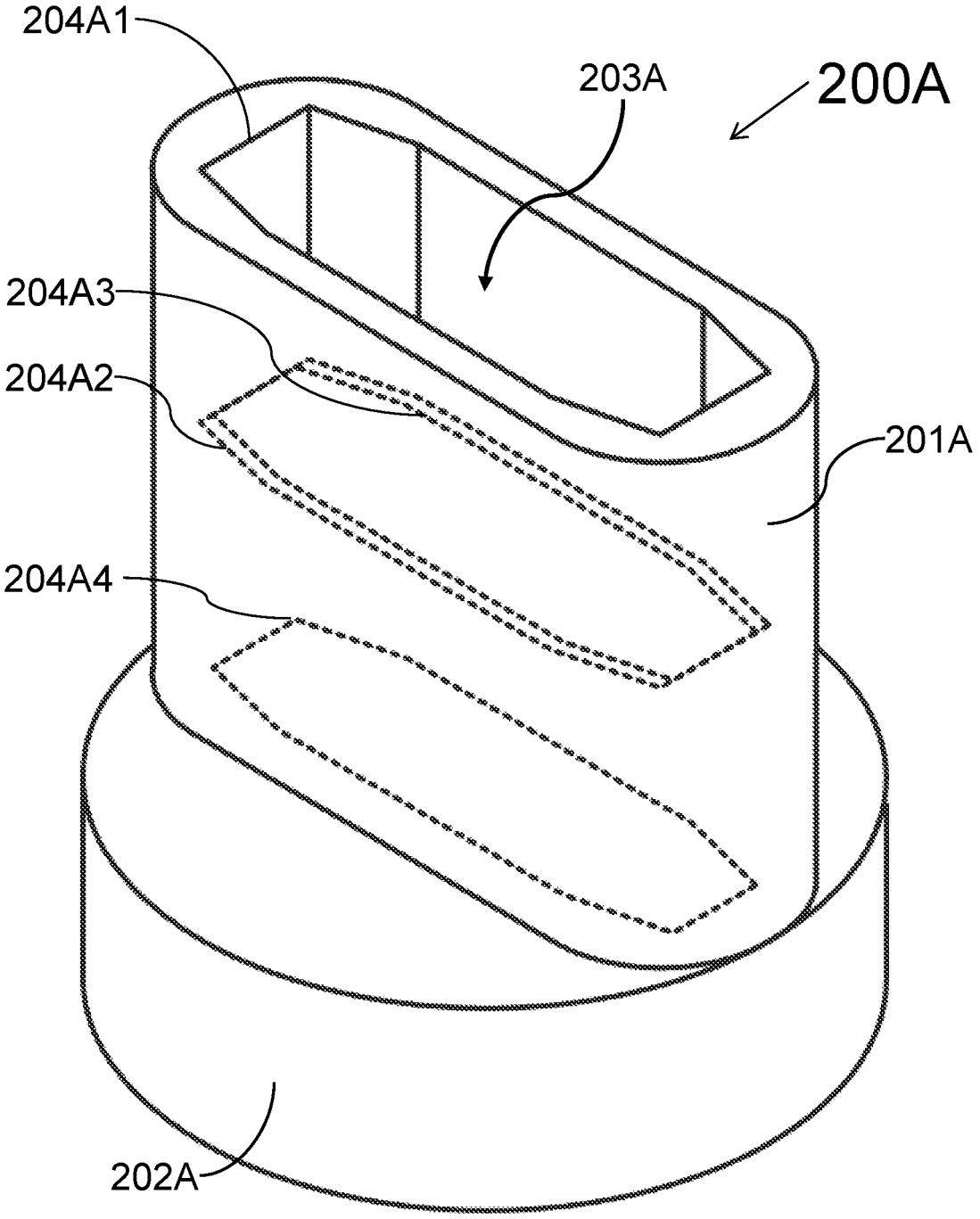
FIG. 18B is a perspective view of socket-configuration 1 according to the subject invention.

FIG. 18B: Perspective View of Socket Configuration 1

FIG. 18B is a perspective view of a coupler 200A according to the subject invention. It consists of a socket 201A and a coupler base 202A. Socket 201A has a slot 203A in its upper face to accept the eye of a host blind. Slot 203A has an upper portion and a lower portion with differing cross-sections: the upper portion of slot 203A is bounded by a top cross-section 204A1 and a middle cross-section 204A2, while the lower portion of slot 203A is bounded by a middle cross-section 204A3 and a bottom cross-section 204A4. Top and middle cross-sections 204A1 and 204A2 have the same shape, and middle and bottom cross-sections 204A3 and 204A4 have the same shape. Cross-sections 204A3 and 204A4 are narrower than cross-sections 204A1 and 204A2; thus, slot 203A is axially tapered, i.e. it has a cross-section which becomes narrower (between middle cross-sections 204B and 205A) with depth into the slot.

Referring again to FIG. 18A, the upper portion of slot 203A is intended to accept eyes whose thickness/OD combinations fall above a line connecting points B1 and B2, while the lower portion is intended to accept eyes whose thickness/OD combinations fall on or below a line connecting points B1 and B2.

Figure 18C:
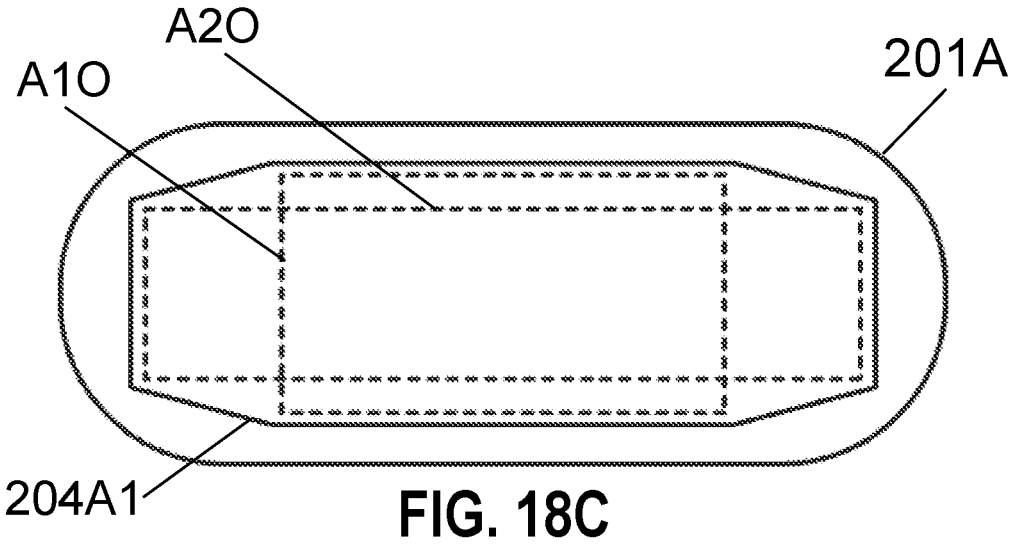
FIG. 18C is a plan view of the top section of socket-configuration 1 according to the subject invention.

FIG. 18C: Plan View of Top of Socket 201A

FIG. 18C is a plan view of the top of socket 201A, including cross-section 204A1. Also shown are two rectangular outlines, A1O and A2O, whose dimensions correspond to the combinations A1 and A2 of eye thickness and OD shown in FIG. 18A. It can be seen that cross-section 204A1 is in the shape of an oblong bar (i.e. a bar whose length is greater than its width), that cross-section 204A1 is radially tapered (i.e. its width decreases with distance from its center), and that it tightly encloses outlines A1O and A2O.

Thus, referring to FIGS. 18A, 18B, and 18C, it can be seen that the upper portion of slot 203A, bounded by cross-sections 204A1 and 204A2 is capable of transferring rotary motion to eyes with thickness/OD combinations A1 or A2 with essentially zero backlash. Also, due to the radially tapered shape of cross-sections 204A1 and 204A2, the same is true for any and all eyes whose thickness and OD fall on the dotted line connecting points A1 and A2 of FIG. 18A.

Figure 18D:
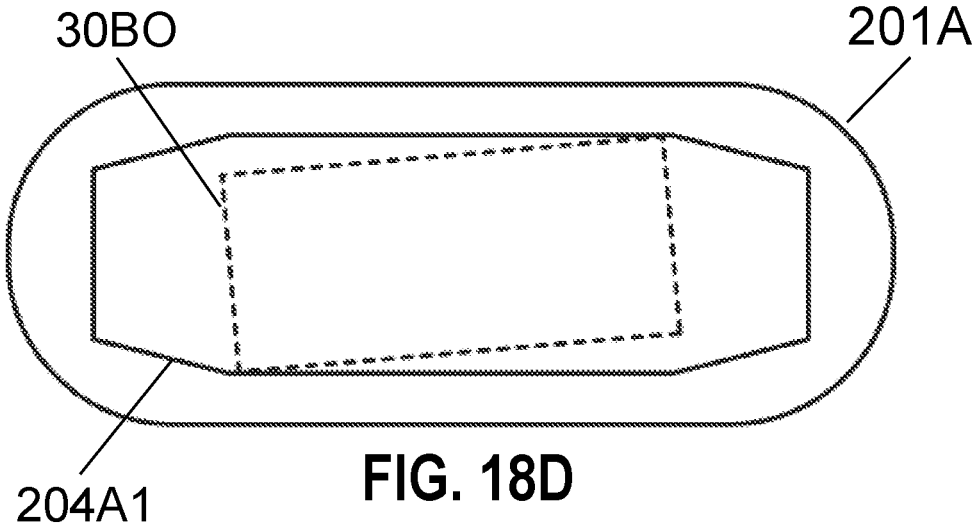
FIG. 18D is a plan view of the top section of socket-configuration 1 showing the worst-case backlash.

FIG. 18D: Worst-Case Backlash with Upper Portion of Slot FIG. 18D is also a plan view of the top of socket 201A, including cross-section 204A1, but showing an outline 30BO of eye 30B of FIG. 2D. Eye 30B has a thickness/OD combination corresponding to point B1 of FIG. 18A. Outline 30BO is angularly displaced relative to cross-section 204A1, showing the backlash with this configuration, which is about 5 degrees. Because the upper portion of slot 203A is intended to only accept eyes above a line connecting points B1 and B2, the actual backlash will always be slightly less than this value.

FIG. 18E: Plan View of Middle of Socket 201A

FIG. 18E is a plan view of the middle of socket 201A, including cross-section 204A3. Also shown are two rectangular outlines, B1O and B20, whose dimensions correspond to the combinations B1 and B2 of eye thickness and OD shown in FIG. 18A. Like cross-section 204A1, cross-section 204A3 is in the shape of an oblong bar (i.e. a bar whose length is greater than its width) and is radially tapered (i.e. its width decreases with lengthwise distance from its center). Cross-section 204A3 tightly encloses outlines B1O and B20.

Figure 18F:
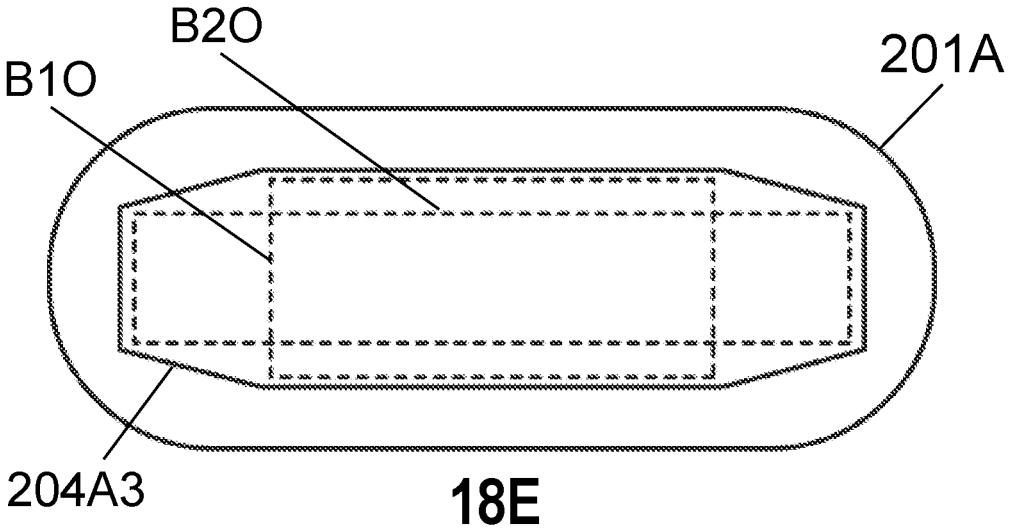
FIG. 18F is a plan view of the bottom section of socket-configuration 1 showing the worst-case backlash.
Figure 18F:
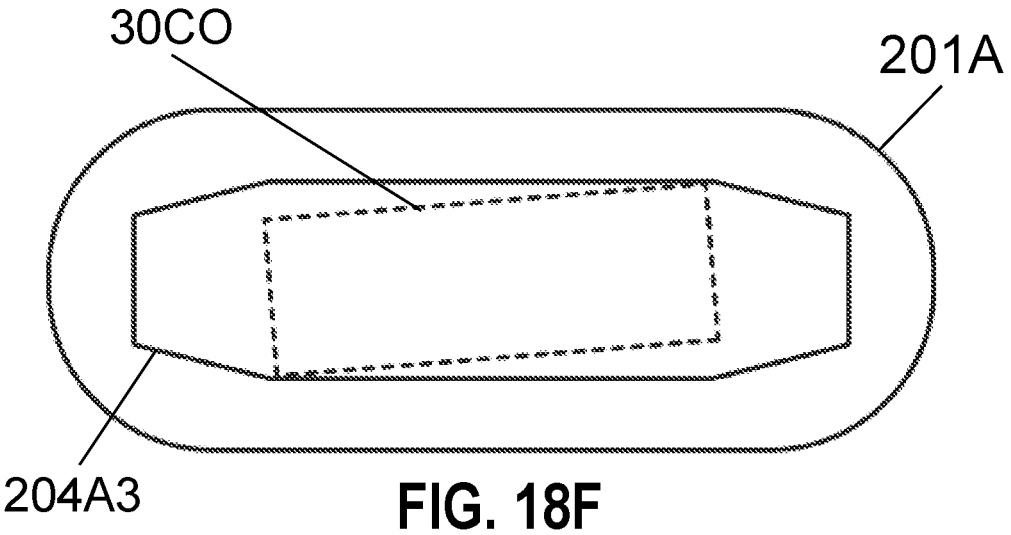

FIG. 18F: Worst-Case Backlash with Lower Portion of Slot FIG. 18F is also a plan view of the middle of socket 201A, including cross-section 204A3, but showing an outline 3000 of eye 30C of FIG. 2D. Eye 30C has the smallest thickness of the eyes plotted in FIG. 18A. Because this is the narrowest eye, it will result in the greatest backlash. Outline 3000 is angularly displaced relative to cross-section 204A3 to show the backlash with this configuration, which is about 5 degrees. The actual backlash will always be slightly less than this value.

Advantages of Socket Configuration 1

Comparing FIG. 17B to FIGS. 18D and 18F, it can be seen that the worst-case backlash with socket 201A is less than half of the backlash resulting from use of conventional socket 201. The reduction in backlash is due to the fact that slot 203A of FIG. 18B is tapered both axially and radially (i.e. the slot has a cross-section whose area decreases with depth into the slot, and whose width decreases with distance from the center of the cross-section), in order to exploit the inverse relationship between eye thickness and OD.

Further, no special steps are necessary during installation to achieve this reduced backlash; the host eye is simply inserted as far as possible into slot 203A.

However, in order to achieve this reduced backlash, socket 201A must be approximately twice as tall as socket 201, because slot 203A effectively consists of two vertically-stacked slots. This increased height could be an issue in some applications.

FIGS. 19A-19F: Socket Configuration 2

The same principles underlying the innovative configuration of socket 201A can be used to further reduce the worst-case backlash, while also reducing required socket height, relative to socket 201A. Both of these objects can be accomplished by adding one or more slots to the socket.

Figure 19A:
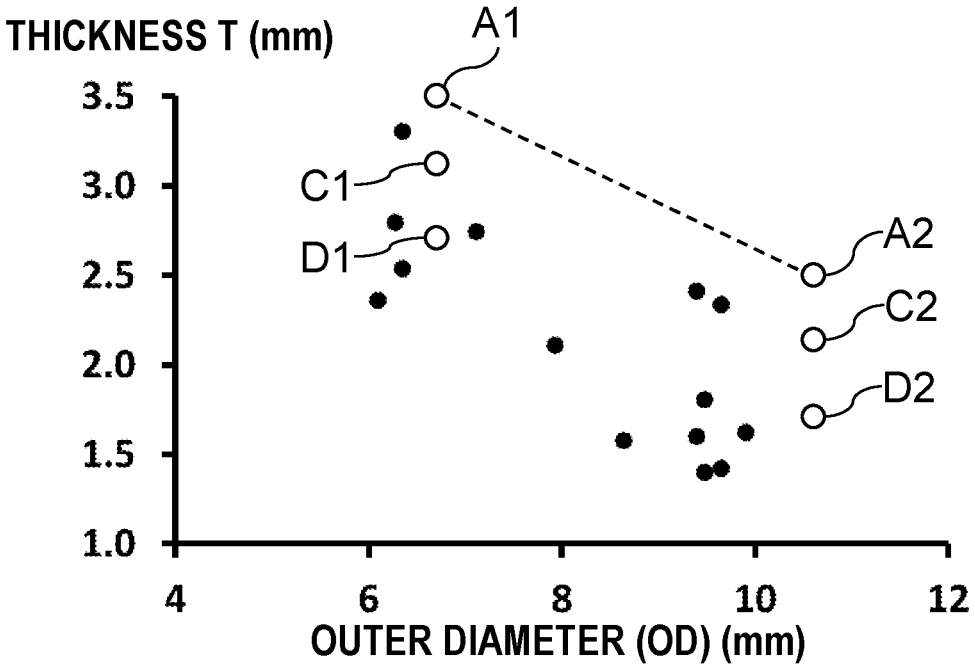
FIG. 19A shows the same scatter plot of FIG. 16 with selected thickness/OD combinations.

FIG. 19A: Eye Thickness Versus Eye OD and Selected Thickness/OD Combinations FIG. 19A shows the same eye thickness-versus-diameter plot of FIG. 16, but without points B1 and B2 and with four additional points, C1, C2, D1, and D2.

Figure 19B:
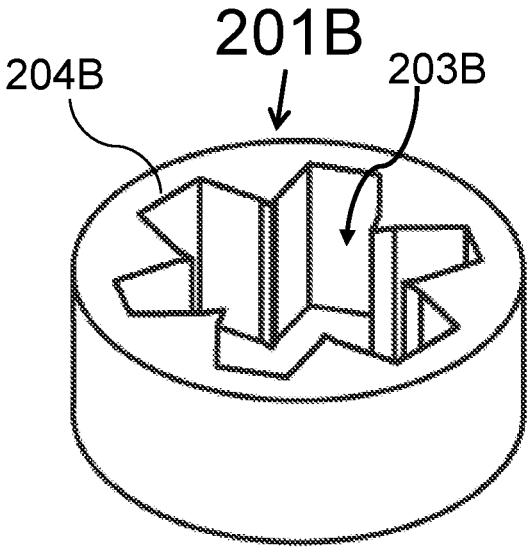
FIG. 19B is a perspective view of socket configuration 2 according to the subject invention.

FIG. 19B: Perspective View of Socket Configuration 2

FIG. 19B is a perspective view of a socket 201B according to the second socket configuration of the subject invention. Socket 201B has a recess 203B in its upper face to accept the eye of a host blind. Recess 203B has a star-shaped cross-section 204B.

Figure 19C:
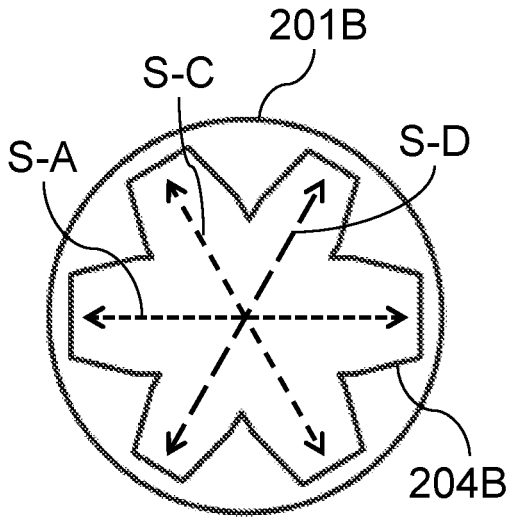
FIG. 19C is a plan view of socket configuration 2 showing the multi-slot configuration.

FIG. 19C: Plan View of Top of Socket 201B

FIG. 19C is a plan view of the top of socket 201B and cross-section 204B. Referring also to FIG. 19B, it can be seen that recess 203B is the union of three slots which are denoted in the plan view of FIG. 19C as a slot S-A, a slot S-C, and a slot S-D, each of which has a different cross-section.

Referring again to FIG. 19A, slot S-A is intended to accept eyes whose thickness/OD combinations are on or below the dotted line connecting points A1 and A2. Similarly, slot S-C is intended to accept eyes whose thickness/OD combinations are on or below a line connecting points C1 and C2, and slot S-D is intended to accept eyes whose thickness/OD combinations are on or below a line connecting points D1 and D2.

Figure 19D:
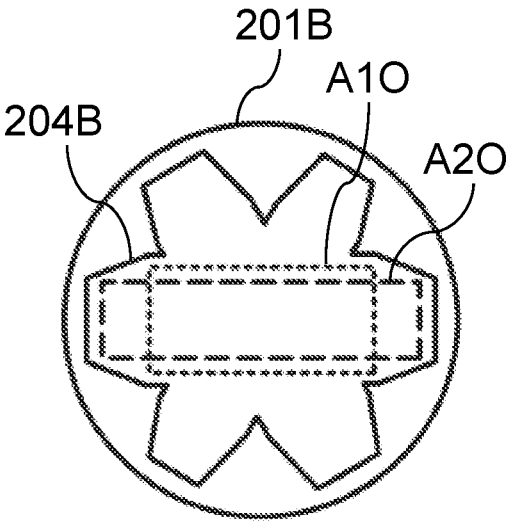
FIGS. 19D-19F are plan views of socket configuration 2 with outlines of host eyes of various sizes.
Figure 19E:
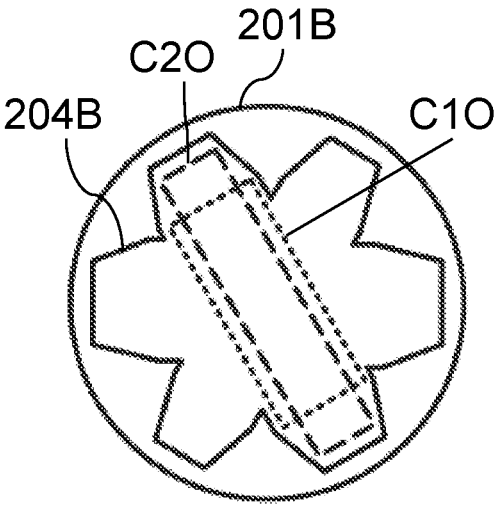
Figure 19F:
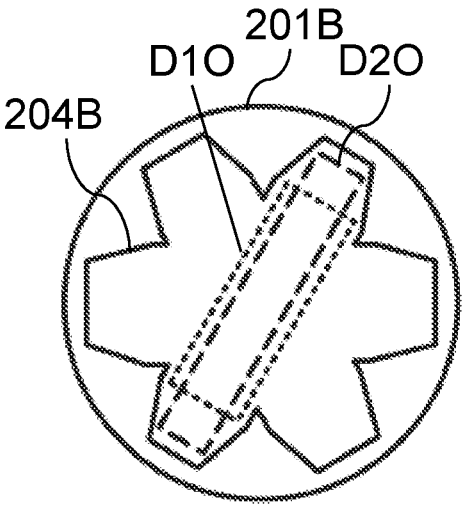

FIGS. 19D-19F: Plan Views of Top of Socket 201B Showing Eye Outlines FIGS. 19D-19F are plan views showing how slots S-A, S-C, and S-D of FIG. 19C are shaped to accept eyes of certain dimensions:

- FIG. 19D shows that slot S-A of FIG. 19C (not labeled in FIG. 19D) is a radially-tapered slot that tightly encloses outlines A1O and A2O, which correspond to the eye thickness/OD combinations of points A1 and A2 of FIG. 19A.
- FIG. 19E shows that slot S-C of FIG. 19C (not labeled in FIG. 19D) is a radially-tapered slot that tightly encloses an outline C10 and an outline C20, which correspond to the eye thickness/OD combinations of points C1 and C2 of FIG. 19A.
- FIG. 19F shows that slot S-D of FIG. 19C (not labeled in FIG. 19D) is a radially tapered slot that tightly encloses an outline D10 and an outline D20, which correspond to the eye thickness/OD combinations of points D1 and D2 of FIG. 19A.

Advantages of Socket Configuration 2

Socket 201B is used to transfer rotary motion to an eye of a host blind by inserting the eye into whichever of slots S-A, S-C, or S-D which provide the tightest fit (and thus the smallest backlash). Because three different cross-section sizes are available to accept the host eye—instead of just two cross-section sizes for socket 201A (as shown in FIG. 18B)—socket 201B has a worst-case backlash of only two-thirds that of socket 201A.

Further, because the slots of socket 201B are displaced angularly (as shown in FIG. 19C), rather than vertically as in the case of socket 201A (as shown in FIG. 18B), socket 201B need not be as tall as socket 201A, which helps to minimize the overall size of a motorization system incorporating socket 201B.

However, socket 201B requires slightly greater effort during installation that socket 201A. This is because some trial-and-error may be needed to determine which of slots S-A, S-C, or S-D will yield the smallest backlash.

Potential Variations in Socket Configuration

As made clear in the preceding discussion, the innovative socket configuration of the subject invention achieves broad compatibility with host eyes without excessive backlash. This is achieved by including a slot which is tapered radially, axially, or both radially and axially. For example, socket 201A shown in FIG. 18B has a slot which is tapered both radially and axially:

The slot is tapered radially because it has a cross-section that becomes narrower with distance from its center, as evident in cross-section 204A1 of FIGS. 18C and 18D.

The slot is tapered axially because its cross-section becomes narrower with depth: cross-sections 204A3 and 204A4 are narrower than cross-sections 204A1 and 204A2, as shown in FIG. 18B.

On the other hand, the slots of recess 203B of socket 201B are tapered only radially (i.e. the widths of slots S-A, S-C, and S-D of FIG. 19C decrease with distance from the center), and not axially.

Figure 20A:
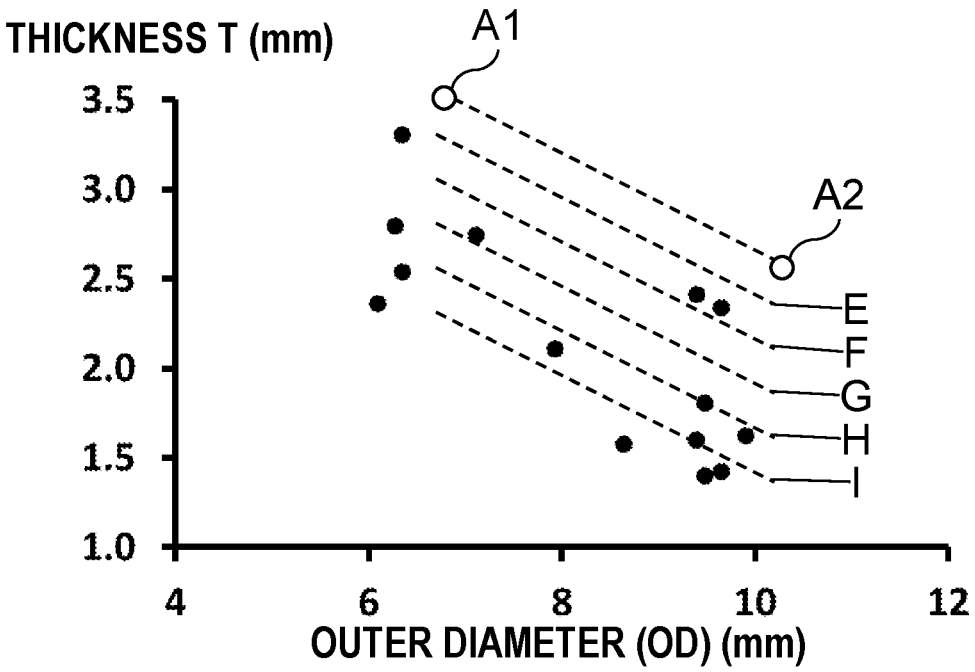
FIG. 20A shows the same scatter plot of FIG. 16 with selected thickness/OD combinations.
Figure 20B:
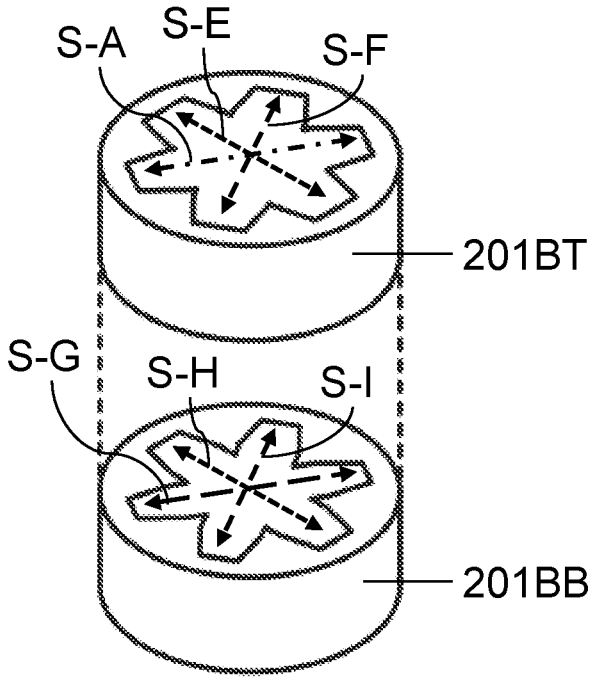
FIG. 20B shows an exploded perspective view of a stacked-socket configuration according to the subject invention.

FIGS. 20A-20B: Adding Axial Taper to Slot 201B

Practitioners will appreciate that an axial taper could be added to socket 201B, i.e. by making the cross-section of recess 203B smaller with depth. This could be done, e.g., by axially stacking two modified versions of socket 201B, the top version having a recess with a slightly larger cross-section than the recess of the bottom version. This would provide six radially-tapered slots: three slots on the top version of the socket (analogous to slots S-A, S-C, and S-D of FIG. 19C), and three slots on the bottom version of the socket. Such a six-slot configuration can be exploited to further reduce the backlash (relative to socket 201B) by using smaller increments in width between the slots.

For example, FIG. 20A shows the eye thickness/OD combinations of FIG. 19A, but without points C1, C2, D1, and D2 and with five additional dotted lines, E-I. Each of lines E-I represents an inverse relationship between eye thickness and OD which could be accommodated by one of the six aforementioned slots.

This is further illustrated in the exploded perspective view of FIG. 7B, which shows a socket configuration consisting of a top socket portion 201BT and a bottom socket portion 201BB.

Socket portion 201BT has a recess which consists of the union of three slots: slot S-A, a slot S-E, and a slot S-F:

Slot S-A accommodates eyes whose thickness and OD fall on or below the dotted line connecting points A1 and A2 of FIG. 20A.

Slot S-E accommodates eyes whose thickness and OD fall on or below line E of FIG. 20A.

Slot S-F accommodates eyes whose thickness and OD fall on or below line F of FIG. 20A.

Similarly, socket portion 201BB has a recess which consists of the union of three slots: slot S-G, a slot S-H, and a slot S-I:

Slot S-G accommodates eyes whose thickness and OD fall on or below line G of FIG. 20A.

Slot S-H accommodates eyes whose thickness and OD fall on or below line H of FIG. 20A.

Slot S-I accommodates eyes whose thickness and OD fall on or below line I of FIG. 20A.

Comparing FIG. 20A to FIG. 19A, it can be seen that the configuration of FIG. 20B reduces the worst-case backlash by one-half relative to socket 201B. However, this would necessitate doubling the height of the socket, which could be disadvantageous in some applications, and the worst-case backlash with socket 201B is already acceptably low.

Figure 21A:
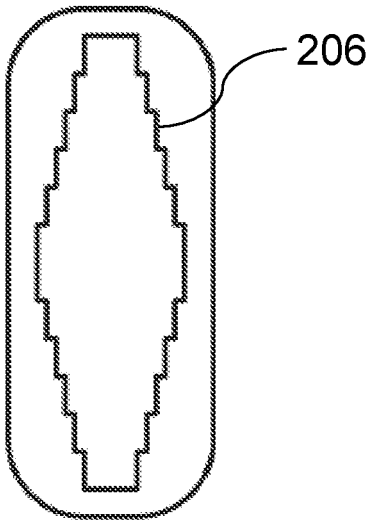
FIGS. 21A and 21B are plan views of a socket configuration according to the subject invention showing different forms of radial taper.
Figure 21B:
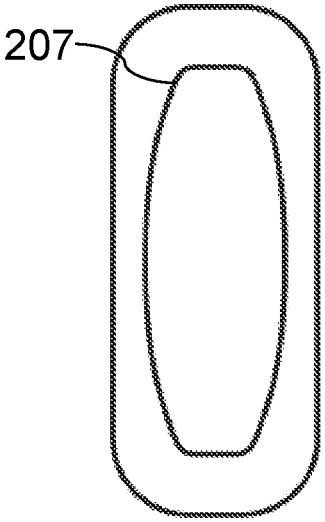

FIGS. 21A and 21B: Variations in Radial Taper

As evident in FIGS. 18C, 18E, and 19C-19F, the radial tapers of the slots of sockets 201A and 201B are linear tapers. For example, in FIG. 18C, the width of cross-section 204A1 is reduced linearly with distance from the center of cross-section 204A1 beyond the boundary of outline A10.

However, as shown in FIGS. 21A and 21B, other forms of radial taper could also be used. For example, FIG. 21A shows a cross-section 206 with a stepped taper, which approximates a linear taper, while FIG. 21B shows a cross-section 207 with a curved taper. However, depending on the number of steps, the use of a stepped taper could significantly increase tooling costs (e.g. for injection molding), and neither a stepped taper nor a curved taper currently appears to offer significant advantages over a linear taper.

Variations in Axial Taper

The axial taper of slot 203A depicted in FIG. 18B is a stepped taper, i.e. the size of the cross-section of the slot decreases abruptly, not gradually, with depth. A linear or curved taper could also be used, as described above. However, a linear taper would offer no significant advantage in tooling costs in this case, because there is only a single step (change) in cross-section. A curved taper also appears to offer no significant advantage over a linear taper.

Fabrication of Socket

A socket according to the subject invention can be fabricated of conventional materials and using conventional means. Prototypes were fabricated from nylon using both Fused Deposition Modeling (FDM) and Stereolithographic (SLA) 3-D printing, but could also be machined from nylon (or similar plastics) or metal. Production plastic parts would most advantageously be injection-molded.

It may also be advantageous to fabricate production versions of the socket from an elastomeric material (this could also be done for prototypes, but elastomers are currently less amenable to 3D printing than plastics). If an elastomer is used, the size of the socket cross-section can be reduced slightly to provide a friction-fit to further reduce the backlash. Another advantage of using an elastomer or other flexible material is that it can add compliance to the drive-train, mitigating the effects of misalignments.

However, use of an excessively flexible material could result in excessive backlash, particularly with blinds in which relatively high torque is required to rotate the control shaft.

Advantages and Disadvantages of Socket Configuration

The socket configuration described above is capable of accommodating the eyes of virtually all wand-operated blinds with minimal backlash. Further, coupling with the host eye is achieved by merely inserting the eye into the socket as deep as possible, so installation is extremely easy. However, there are two potential issues in the use of the socket configurations described above.

First, it does not provide a secure attachment to the host eye in the axial dimension, i.e. it must be held in place axially after installation. Otherwise, backlash could increase or the socket could become completely uncoupled from the host eye.

Second, the socket configuration is not necessarily self-aligning: depending on its shape, inserting an eye into the socket as far as possible will not necessarily ensure that the axis of rotation of the coupler/socket is aligned with that of the control shaft of the host blind. The risk of misalignment is greatest when the eye is non-circular or has a center which is offset from the control shaft's axis of rotation.

As discussed below in "Synergistic Use of Coupler with Motorization system", both of these potential issues are mitigated when the coupler is used with the motorization system of the subject invention.

FIGS. 22A-22E: "Flexible Tab" Coupler Configuration 1

Like the socket configuration described above, the "flexible tab" configuration mitigates backlash while still preserving compatibility with eyes of various dimensions. However, it also provides a more secure attachment to the host eye at the expense of requiring an additional step during installation.

Figure 22A:
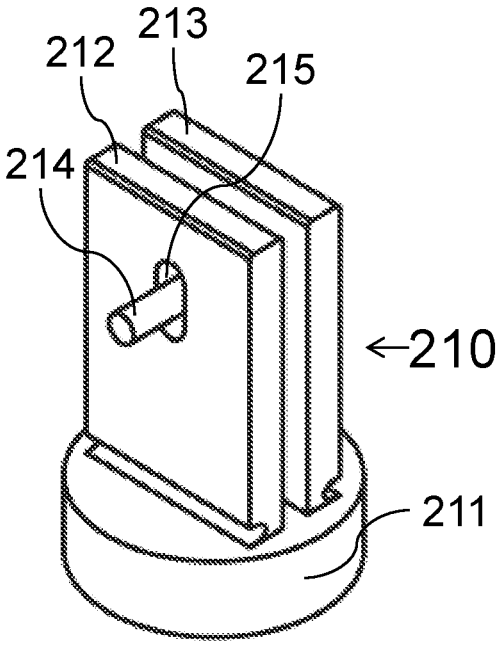
FIGS. 22A and 22B are perspective views of flexible-tab coupler configuration 1 according to the subject invention.
Figure 22B:
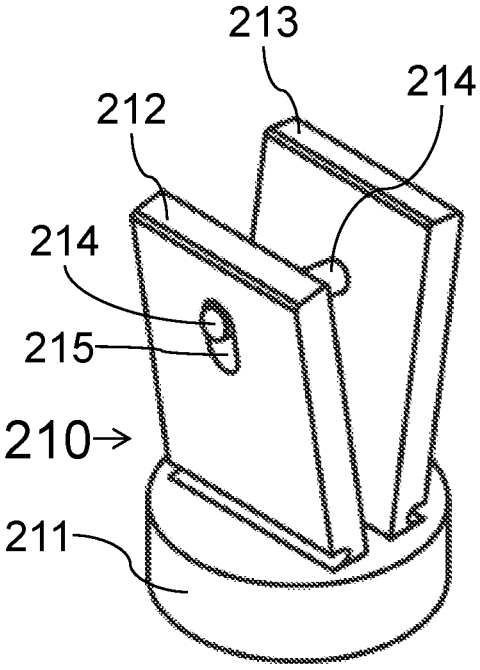

FIGS. 22A-22B: Perspective Views of Flexible-Tab Configuration 1 FIGS. 22A and 22B show perspective views of a coupler 210 of the flexible-tab configuration. Coupler 210 consists of a coupler base 211, a pair of tabs (tab 212 and tab 213) flexibly attached to base 211, a pin 214 attached to tab 213, and an oblong hole 215 in tab 212. A slot is thereby formed between the opposing surfaces of tabs 212 and 213. The flexible attachments between tabs 212 and 213 and base 211 allow the tabs to be spread apart, e.g. by wedging the blade of a screwdriver between them and twisting, thereby increasing the width of the slot. In the most straightforward implementation, coupler 210 is made of a flexible but stiff material (e.g. nylon), and the bottoms of tabs 212 and 213 (where they attach to base 211) are notched (as shown) so that the tabs can flex along their attachments to the base.

FIG. 22A shows tabs 212 and 213 in the nominal (un-spread) position. In this position, the opposing faces of tabs 212 and 213 are parallel, and the distance between them (i.e. the slot width) is no greater than the minimum expected eye thickness T (i.e. about 1.3 mm in the case of the eyes whose dimensions are depicted in FIG. 16). With the tabs in this position, pin 214 passes through hole 215 in tab 212. Thus, in this position, the thinnest eyes can be engaged between the opposing faces of tabs 212 and 213, and secured in place with pin 214 passing through the eye and into tab 213, so that rotary motion of coupler 210 can be transferred to the eye.

FIG. 22B shows tabs 212 and 213 in a partially-spread-apart position. In this position, tabs 212 and 213 are spread apart in order to accommodate the thickest expected eye (e.g. an eye with a thickness T of about 3.3 mm, per FIG. 5). Despite the fact that tabs 212 and 213 are partially spread apart, Pin 214 still extends into hole 215 in tab 212, thereby locking the host eye in place.

Figure 22C:
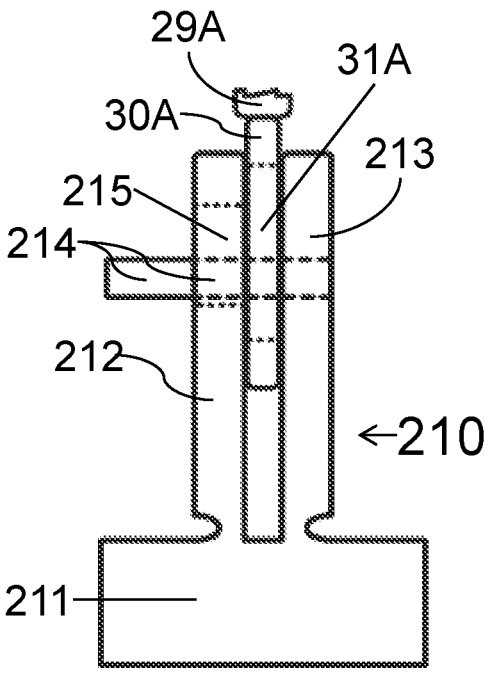
FIGS. 22C-22E are side views of flexible-tab coupler configuration 1 according to the subject invention.
Figure 22D:
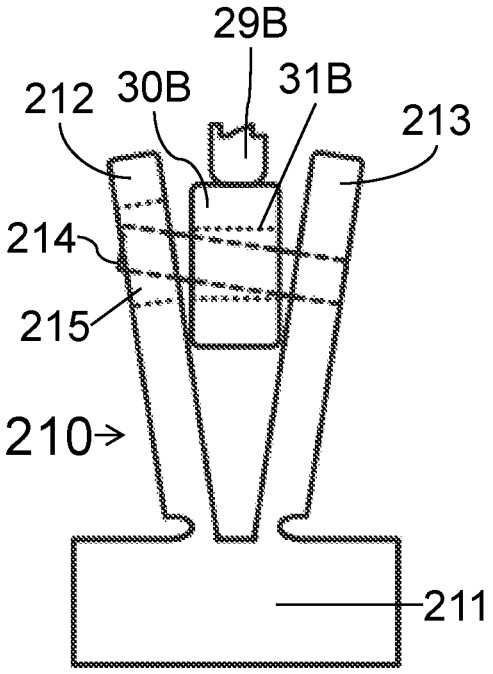
Figure 22E:
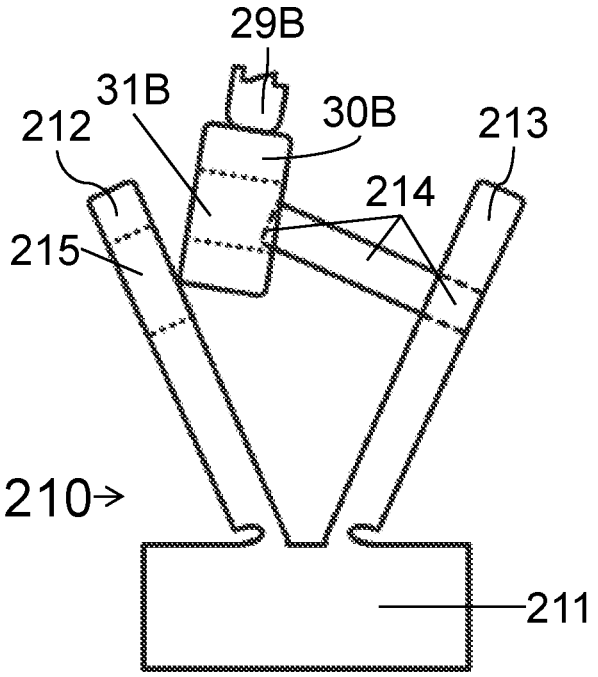

FIGS. 22C-22E: Side Views of Flexible-Tab Configuration 1 FIG. 22C is a side view of coupler 210 engaging eye 30A of FIG. 2D. Pin 214 passes through hole 31A of eye 30A and then through hole 215 of tab 212, locking eye 30A in place. This is advantageous during installation of coupler 210 on a host eye, as will be discussed in a subsequent section.

Eye 30A has the smallest thickness T (about 1.3 mm) of the eyes shown in FIG. 16. As previously stated, the distance between the opposing faces of tabs 212 and 213 when the tabs are in the nominal (un-spread) position is also about 1.3 mm, so there is virtually no clearance between the opposing surfaces of tabs 212 and 213 and the proximal surfaces of eye 30A. Thus, there is no backlash of the type experienced by ordinary coupler 200 (as previously shown in FIGS. 17A and 17B). However, the flexibility of tabs 212 and 213 relative to base 211 provides another potential source of backlash: torque between coupler 210 and eye 30A will create forces that tend to spread tabs 212 and 213 apart. The stiffness of the flexible attachment between each tab and base 211 must be great enough to limit this backlash to acceptable levels.

FIG. 22D is a side view of coupler 210 engaging eye 30B of FIG. 2D. Eye 30B has the largest thickness T (about 3.3 mm) of the eyes shown in FIG. 16, so that it spreads tabs 212 and 213 partially apart. As a result, pin 214 does not protrude completely through hole 215 of tab 212, but still penetrates hole 215 sufficiently to lock Eye 30B in place. As in FIG. 22C, there is no backlash of the type experienced by ordinary coupler 200, because the lower portion of eye 30B makes direct contact with tabs 212 and 213. Further, because the tabs are already spread apart by the thickness of eye 30B, they exert pressure on eye 30B that tends reduce the backlash caused by torque-induced spreading forces. However, the relatively small OD of eye 30B reduces the distance that the tabs are spread apart for a given amount of angular backlash, which tends to increase the backlash. Further, the relatively small OD of eye 30B causes the contact points between it and tabs 212 and 213 to occur higher along the coupler (i.e. further from the attachments between the tabs and base 211), which increases the leverage of the torque-induced spreading forces and thus also tends to increase the backlash. For these reasons, the net backlash with eyes having a small OD, such as eye 30B, can be substantial with this configuration.

FIG. 22E is a side view of coupler 210 with tabs 212 and 213 spread apart far enough so that eye 30B can pass between tab 212 and the end of pin 214, and thence into the position shown in FIG. 22D. Because eye 30B is the thickest expected eye, this scenario defines the maximum required spread of tabs 212 and 213. Typically, tabs 212 and 213 are spread apart enough to permit insertion of the host eye by placing the blade of a screwdriver between the tabs and then twisting the screwdriver. The screwdriver torque required to achieve this must be comfortably within the capabilities of a typically installer, e.g. of the order of 1 Nm.

Trade-Off in Stiffness of Tab Attachments

With the background provided by FIGS. 22A-22E, it can be seen that there are conflicting requirements on the stiffness of the flexible attachments between tabs 212 and 213 and base 211:

If the stiffness is too low, then torque between coupler 210 and the host eye will tend to spread the tabs apart, potentially resulting in unacceptable backlash. As noted above, this is especially true with eyes having a relatively small OD.

On the other hand, if the stiffness is too high, then it may be too difficult to spread the tabs apart (e.g. by prying with a screwdriver) far enough to engage the eye. This is also particularly true with eyes having a relatively small OD (because, per FIG. 16, such eyes typically also have a relatively large thickness T).

Referring to FIGS. 22C and 22D, the difference in backlash between eyes of varying ODs can be mitigated by making tabs 212 and 213 taller to increase the vertical distance between pin 214 and base 211, and then commensurately increasing the stiffness of the attachments between the tabs and base 211 to resist the expected torque-induced spreading forces. However, this increases the height of coupler 210, which may be undesirable in some situations.

Fabrication of Coupler 210

Referring again to FIG. 22A, base 211 and tabs 212 and 213 of coupler 210 can be readily fabricated of 3D-printed or injection-molded nylon, with pin 214, of steel, thereafter press-fitted into tab 63.

Figure 23A:
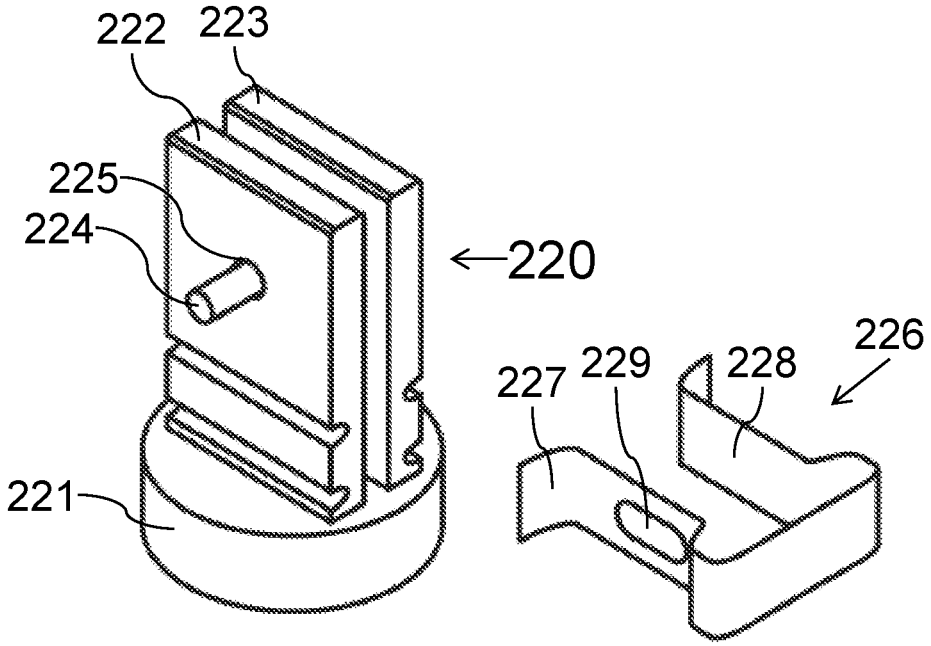
FIGS. 23A-23C are perspective views of flexible-tab coupler configuration 2 according to the subject invention.
Figure 23B:
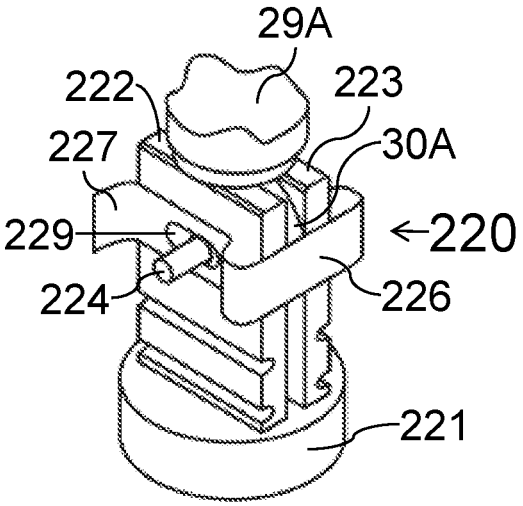
Figure 23C:
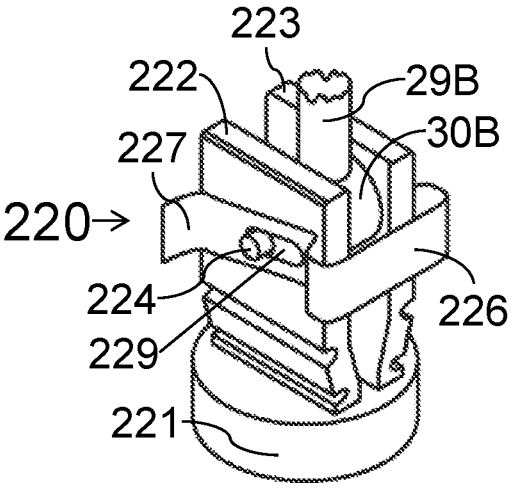

FIGS. 23A-23C: "Flexible Tab" Coupler Configuration 2

In the configuration shown in FIGS. 22A-22E, the stiffness of the flexible attachments between tabs 212 and 213 and base 211 opposes torque-related forces that tend to spread the tabs apart (and which could thereby cause backlash). Alternatively, the requisite stiffness can be provided by a flexible steel clip instead of the flexible attachments between tabs 212 and 213 and base 211. Such a configuration is shown in FIGS. 23A-23C.

FIG. 23A shows a perspective view of a coupler 220 and a clip 226. Coupler 220 consists of a base 221 to which a tab 222 and a tab 223 are flexibly attached, so that a slot is formed between the opposing surfaces of the tabs. A pin 224 is attached to tab 223 and protrudes through a hole 225 in tab 222. The flexibility in the attachments of tabs 222 and 223 is enhanced by a pair of notches in the bases of the tabs, allowing the opposing surfaces of the tabs to move closer or further apart (changing the slot width) while remaining substantially parallel. Coupler 220 is designed so that the slot width between tabs 222 and 223 can vary over the range of expected eye thicknesses, e.g. from 1.3 mm to 3.3 mm for the eyes of FIG. 16.

FIG. 23A also shows a clip 226, which is made of spring steel and includes a pair of parallel leaves, a leaf 227 and a leaf 228. Leaf 227 has a hole 229 whose diameter is slightly greater than the outer diameter of pin 224. The nominal distance between leaves 227 and 228 is no greater than the sum of the thicknesses of tabs 222, 223, and the thinnest expected eye (e.g. 1.3 mm for the eyes of FIG. 16). Leaves 227 and 228 can be forced far enough apart, against spring tension provided by clip 226, so that clip 226 can be placed on coupler 220, with the leaves straddling the tabs and pin 224 protruding through hole 229.

FIG. 23B shows a perspective view of coupler 220 and clip 226 coupled to relatively thin eye 30A, while FIG. 23C shows a perspective vice of coupler 220 and clip 226 coupled to relatively thick eye 30B. In both cases, the coupling is achieved by first spreading the tabs far enough apart so that the eye can inserted between them and locked in place with the pin, in a manner similar to that shown for coupler 210 in FIGS. 22C-22E. Then clip 226 is installed by forcing its leaves far enough apart so that it can be pressed on to coupler 220, straddling tabs 222 and 223 and with pin 224 passing through hole 229.

When installed in this position, spring tension in clip 226 forces tabs 222 and 223 together, opposing torque-induced forces that tend to spread them apart.

Design of Clip 226

Clip 226 is designed to meet three criteria:

The nominal spacing between the opposing surfaces of leaves 227 and 228 (i.e. without forcing the leaves apart) is no greater than the sum of the thicknesses of tab 222, tab 223, and the thinnest expected host eye. This ensures that the opposing (inner) surfaces of leaves 227 and 228 will make contact with the outer surfaces of tabs 222 and 223 even when coupling to the thinnest expected host eye (e.g. eye 30A of FIG. 23B).

The stiffness of clip 226 is high enough so that the pressure exerted by leaves 227 and 228 on tabs 222 and 223 is sufficient to limit torque-induced backlash to acceptable levels even with the thinnest expected eye (e.g. eye 30A of FIG. 23B).

The stiffness of clip 226 is low enough to permit leaves 227 and 228 to be spread far enough apart to straddle pin 224 (i.e. so that it can be installed as shown in FIGS. 23B and 23C).

Coupler 220 can provide less backlash for a given coupler height and range of eye ODs than coupler 210. However, it requires a separate part (i.e. clip 226), and installation on the host eye is slightly more difficult than for coupler 210.

Fabrication of Coupler 220

With the exception of clip 226, coupler 220 can be fabricated in the same way as coupler 210. Clip 226 is fabricated of spring steel using a conventional process.

Figure 24A:
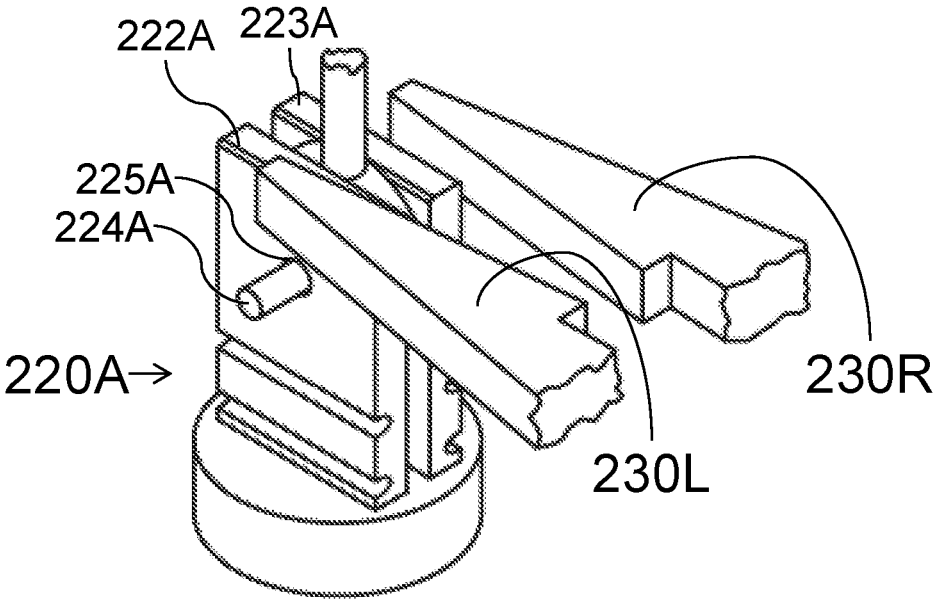
FIGS. 24A-24C are perspective views of the friction-locked flexible-tab coupler configuration of the subject invention.
Figure 24B:
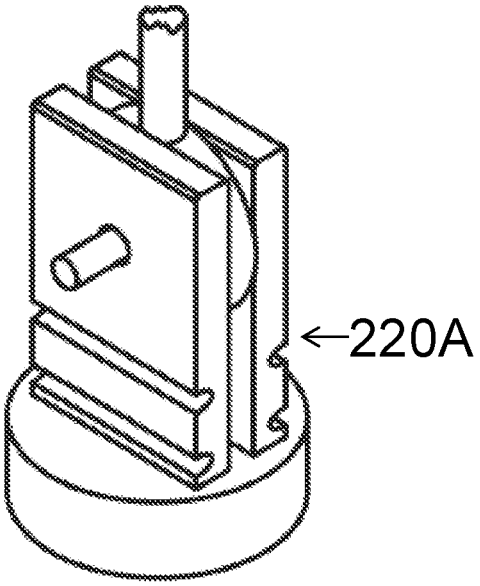
Figure 24C:
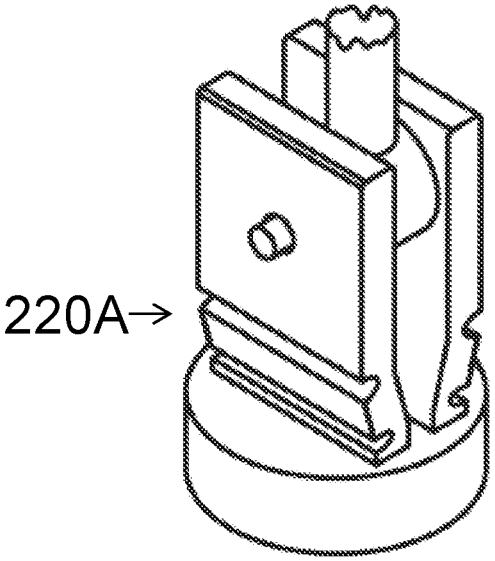

FIGS. 24A-24C: Friction-Locked Flexible Tab Configuration

In the coupler configuration shown in FIGS. 22A-22E, the stiffness of the flexible attachments between tabs 212 and 213 and base 211 opposes torque-related forces that tend to spread the tabs apart (and which could thereby cause backlash), while in the configuration shown in FIGS. 23A-23C, torque-related forces are opposed by the stiffness of clip 226. In both cases, this stiffness represents a trade-off between mitigating backlash and allowing the tabs to be spread far enough apart to accommodate the thickest expected eyes.

However, instead of stiffness provided by spring-like means, the tabs of a flexible-tab coupler can be held together against a host eye by friction (and/or a chemical retaining compound). This can be achieved, e.g., with coupler 220 of FIGS. 23A-23C by reducing the diameter of hole 225 in tab 223 so that pin 224 fits tightly enough in hole 225 to resist torque-induced forces that tend to spread the tabs apart.

Such a coupler 220A is shown in FIG. 24A. Coupler 220A is identical to coupler 220 of FIG. 23A, except that hole 225A is slightly smaller than hole 225 to provide a tight fit with pin 224A. FIG. 24A also shows how tabs 222A and 223A are squeezed together (in this case with tips 230L and 230R of pliers) to press pin 224A as far as possible through hole 225A, locking the host eye in place.

FIG. 24B shows coupler 220A coupled to a relatively thin host eye, while FIG. 24C shows coupler 220A coupled to a relatively thick eye.

Trade-Offs in Design of Coupler 220A

The primary trade-off in the design of coupler 220A is in the tightness of the fit of pin 224A in hole 225A. If this fit is too tight, installation can be excessively difficult, but if too loose, then the tabs can tend to spread apart over time due to torque forces. In testing to date, it has been observed that a fit tight enough to resist torque forces can be achieved while still allowing easy installation with conventional pliers. Further, a conventional chemical retaining compound (e.g. an anaerobic thread-locking compound) can be applied to the fit between pin 224A in hole 225A to increase the security of the press-fit. With judicious choice of the retaining compound, coupler 220 can still remain removable from the host eye, e.g. by prying apart the tabs with a screwdriver.

Fabrication of Coupler 220A

Coupler 220A can be fabricated in the same way as coupler 220, except that clip 226 is not necessary.

Pin Outer Diameter for Flexible Tab Configuration

The flexible-tab configurations described above include a pin that passes through the host eye, locking it in place. The OD of this pin must be no greater than the minimum expected eye ID. A survey of wand-operated blinds in US residential and office buildings revealed a minimum eye ID of 2.4 mm, so the pin OD must be no greater than 2.4 mm.

Advantages and Disadvantages of Flexible Tab Configuration

As with the socket configuration described previously, the flexible-tab configurations described above can accommodate eyes of various shapes and sizes with minimal backlash. In addition, they provide a secure attachment to the host eye via a locking pin, e.g. pin 224A of coupler 220A of FIGS. 24A-24C).

The secure attachment to the host eye is advantageous in two circumstances:

It eliminates the need for a separate means of supporting the weight of the motor assembly. This, in turn, allows the use of a "floating" motor mount (such as that shown in U.S. Pat. No. 5,760,558) which does not fully support the weight of the motor assembly.

Even when there is a separate means of supporting the weight of the motor assembly, a secure attachment between the coupler and the host eye can facilitate installation. Specifically, it can temporarily support the weight of the motor assembly while it and the coupler are being aligned with the blind's control shaft, after which the motor assembly can be secured in place. However, the magnetic attachments of the subject motorization system also provide the same benefit, negating this advantage of a secure coupling. This is further discussed below in "Synergistic Use of Coupler with Motorization System".

However, the flexible-tab configurations also have disadvantages. They require additional installation steps relative to the socket configuration of coupler described previously, specifically to spread the tabs apart and, in the case of couplers 220 and 220A, to attach clip 226 and squeeze the tabs together, respectively.

Further, the OD of the locking pin must be smaller than the smallest expected eye ID, but such a pin will be a loose fit in eyes with larger IDs. The aforementioned survey of blinds found a maximum eye ID of 7 mm. If, as mentioned above, a pin OD of 2.4 mm is used to ensure compatibility with smaller eyes, then there can be up to ±2.3 mm of movement between the pin and larger eyes. This can increase the risk of significant misalignment between the coupler and the control shaft of the host blind.

As discussed below in "Synergistic Use of Coupler with Motorization System", the risks of misalignment can be mitigated by using the coupler in conjunction with the motorization system of the subject invention.

Attachment Between Coupler Base and Motor Output Shaft

The preceding discussion focuses on the innovative aspects of the coupler and does not address the attachment between the coupler base (e.g. base 202A of FIG. 18B) and the output shaft of the motor (e.g. shaft 115A of FIG. 4), which is envisioned to be via conventional attachment means.

As previously described, the couplers of the subject invention are advantageously fabricated of plastic (e.g. nylon) or an elastomeric material. The required conventional attachment means between such a coupler and a motor output shaft will depend on the diameter of the output shaft.

If the output shaft is a small-diameter (e.g. 3 mm) steel shaft, as is typically the case for small gear-motors such as motor 111A of FIG. 4, then it is envisioned that the attachment between the coupler and the shaft be via a metal insert which is bored to accept the output shaft and optionally a set-screw, which can then be molded or press-fit into the coupler base. Alternatively, instead of a set-screw, the metal insert can be designed to provide an interference fit with the motor output shaft, and secured in place with an anaerobic retaining compound. Both methods have been used successfully in prototypes of the subject invention.

On the other hand, if the output shaft has a larger diameter (e.g. 10 mm), as might be case for a gear-motor in which the output gear and output shaft are injection-molded of plastic in one piece, then it is envisioned that the motor output shaft would have a non-circular (e.g. a square or hexagonal) cross-section, which would fit into a similarly-shaped cross-section in the coupler base. The attachment between such a coupler base and motor shaft could be by means of an appropriate adhesive, e.g. a cyanoacrylate glue.

Synergistic Use of Coupler with Motorization System

As the preceding discussion makes clear, the motorization system and coupler of the subject invention are individually advantageous. However they are even more advantageous when used together, as discussed in the following paragraphs.

Combined Use Enables Broad Compatibility with Existing Blinds

The motorization system of the subject invention can accommodate variations in the Y-Z location of the center of a host blind's control-shaft eye (e.g. as shown in FIG. 9), while the coupler can accommodate variations in eye configuration (e.g. as shown in FIG. 2D) and variations in eye thickness and OD (e.g. as shown in FIG. 16). Thus, when used together, the motorization system and coupler assure compatibility with virtually all wand-operated blinds.

Combined Use Facilitates Installation while Minimizing Risk of Misalignments

The coupler configurations of the subject invention are extremely easy to couple to host eyes (particularly in the case of single-slot socket 201A of coupler 200A, as shown in FIG. 18B). However, as previously described, care must be taken during installation of the system to avoid misalignment between the coupler and the control shaft of the host blind. In the case of the socket configurations described herein, this requires a means of supporting the weight of the motor assembly and coupler while making fine adjustments to the orientation and position of the coupler in all three dimensions. As is known in various arts, supporting an object with precise adjustability in position and orientation in three dimensions typically requires a complex and expensive mechanical device. However, the motorization system of the subject invention provides a simple and inexpensive way of achieving the required adjustability in two ways.

First, compliance means 160 of FIG. 3 (e.g. as implemented via a rubber strip, elastomeric bosses, elastomeric motor carrier, or elastomeric coupler as described herein) mitigates the effects of misalignments and therefore reduces the required positioning accuracy for adequate alignment.

Second, the use of magnetic attachments in holding means 150 and headrail mount 141 of FIG. 3 (e.g. as implemented in chassis 140A) provide a way of supporting the weight of the motor assembly (including coupler) while still providing the required adjustability. For example, referring to FIG. 8, the position of the motor assembly (and coupler) can be adjusted along the X-dimension by sliding magnets 141A of chassis 140A along front 23 of headrail 22. Very fine adjustments can be achieved by nudging the chassis back and forth with the thumbs. Similarly, the orientation and position of the motor assembly (and coupler) can be adjusted in the Y-Z plane by sliding and rotating magnet 150A of motor assembly 110A along surface 142A of plate 147A.

Figure 25:
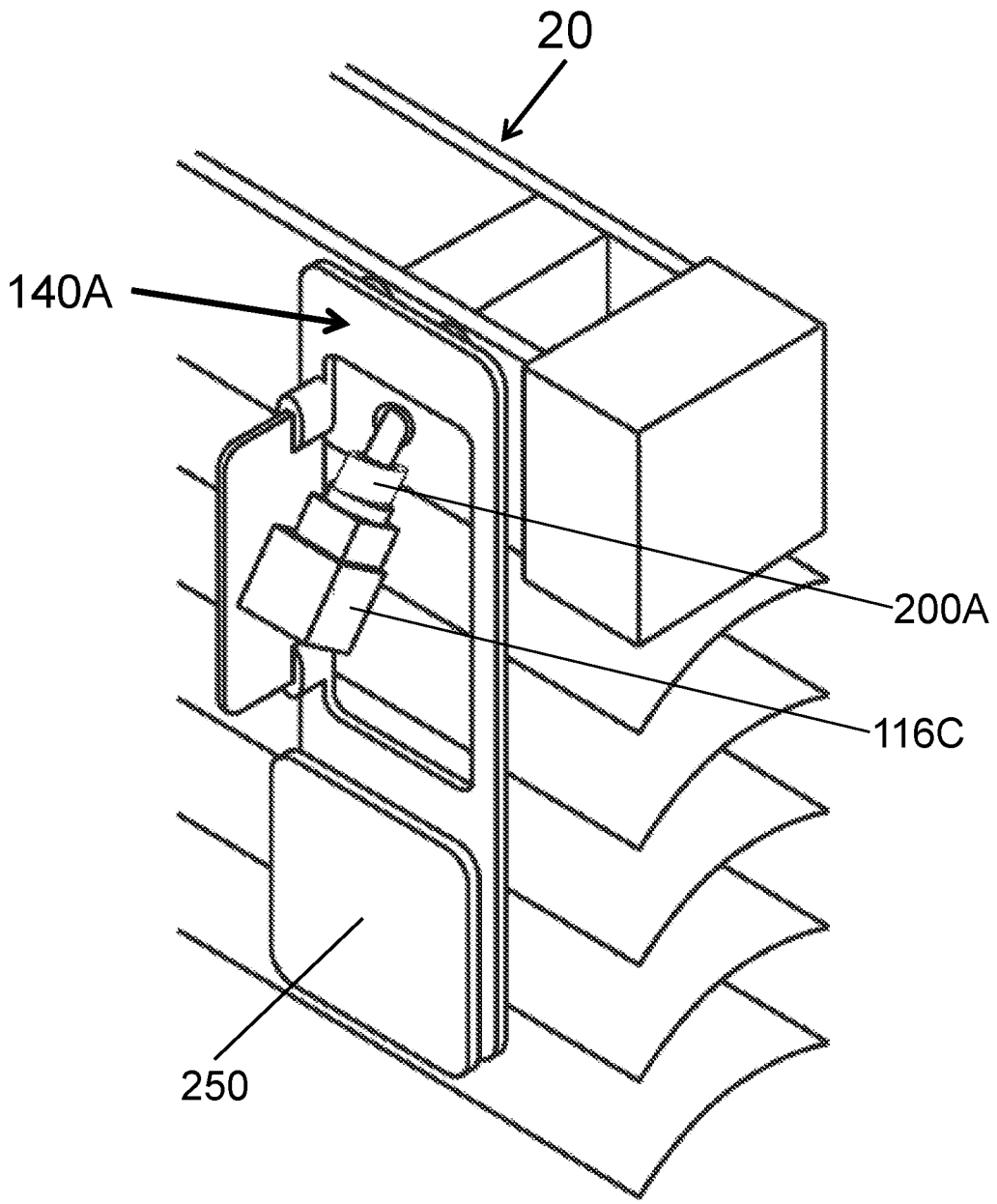
FIG. 25 is a perspective view of a preferred combination of a motorization system and coupler according to the subject invention, optimized for high-volume production, mounted on a host blind.
Figure 26:
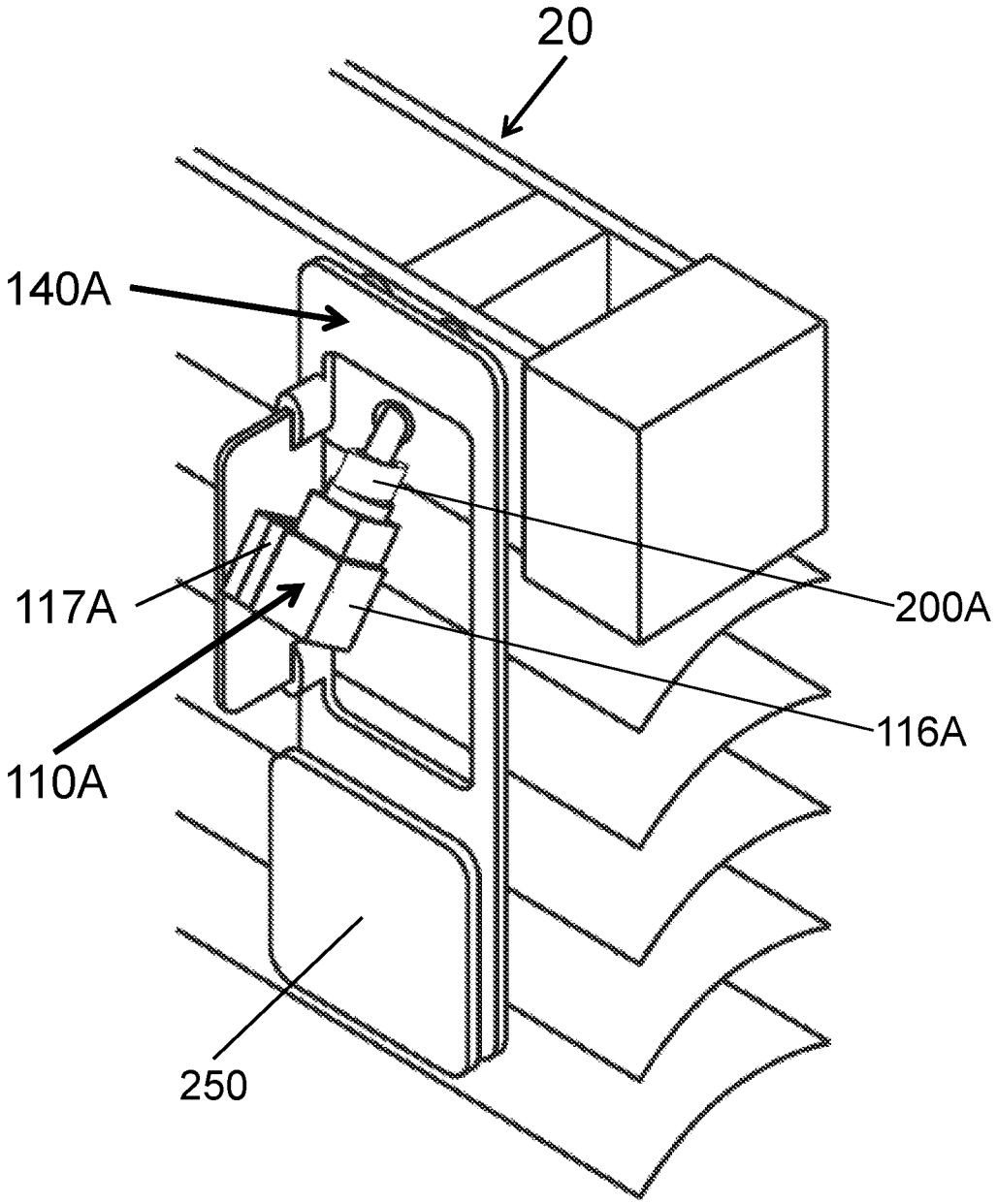
FIG. 26 is a perspective view of a preferred combination of a motorization system and coupler according to the subject invention, optimized for minimum tooling cost, mounted on a host blind.
Figure 27:
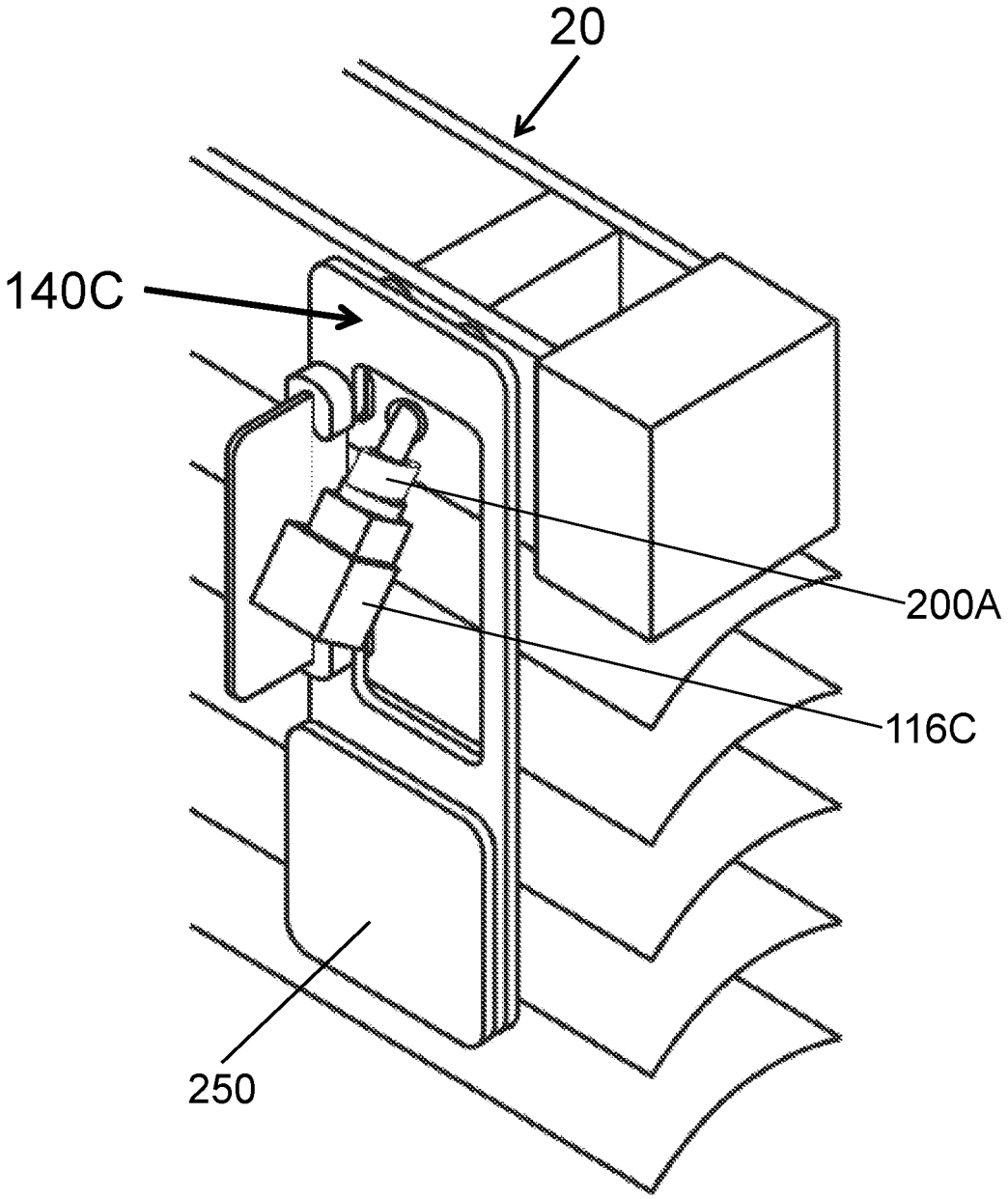
FIG. 27 is a perspective view of a preferred combination of a motorization system and coupler according to the subject invention, optimized to provide increased compliance to mitigate mechanical misalignments, mounted on a host blind

FIGS. 25-27: Preferred Combinations of Motorization System and Coupler

The preceding sections of this disclosure elucidate the various considerations and trade-offs in implementation of the motorization system and coupler of the subject invention, which information can be used by practitioners to optimize the implementation for various applications. The following discussion discusses preferred combinations of the motorization system and coupler for specific applications.

Coupler Considerations for Combined Use

The preferred embodiments of the motorization systems described above use a magnetic attachment as holding means 150 of FIG. 3. This provides a secure enough attachment between motor assembly 110 and chassis 140 that a secure attachment between coupler 120 and the eye of the host blind (e.g. as provided by the pins of couplers 210, 220, and 220A) is not necessary. This enables the use of the socket configuration of the coupler of the subject invention, which does not provide a secure attachment but does minimize installation labor.

Three socket configurations are described: socket 201A of FIGS. 18B-18F which has a single slot that is tapered both radially and axially; socket 201B of FIGS. 19B-19F which has multiple slots that are tapered radially, and a stacked version of socket 201B (consisting of 201BT and 201BB of FIG. 20B) that includes multiple slots that are tapered both axially and radially. These embodiments offer the following advantages:

- Socket 201A is easiest to install because it has only a single slot and therefore does not require trial-and-error to determine the best-fitting slot (to minimize backlash) during installation.
- Socket 201B has the shortest height.
- The stacked socket of FIG. 20B has the lowest backlash because it offers the greatest number of radially-tapered slots to match the host eye dimensions.

When used with the motorization system embodiments disclosed herein, socket 201A is the preferred socket design for the coupler, for the following reasons:

- The worst-case backlash, although greater than that of the stacked-socket configuration of FIG. 20B, is well within acceptable limits.
- Given the size of the motorization system, the additional height of socket 201A relative to that of socket 201B has a negligible impact on the overall size of system 100.
- The easier installation afforded by socket 201A, relative to the other socket configurations, is significant.

Thus, socket 201A is the preferred configuration for a coupler used in combination with the motorization system of the subject invention.

Considerations in Construction of Socket 201A for Combined use

As previously stated, socket 201A can be advantageously fabricated of a rigid plastic (e.g. nylon) or an elastomeric material. A rigid plastic is amenable to 3D-printing as well as injection-molding and is therefore well-suited to prototyping or low-volume production as well as high-volume production. On the other hand, an elastomeric material provides a way to incorporate compliance means 160 of FIG. 3 into the coupler. It also allows the cross-sections of the slot of socket 201A to be made slightly smaller, enabling a tighter fit to host eyes and thereby further reducing backlash. However, an elastomeric coupler but is not as amenable to 3D printing as a rigid plastic coupler.

Thus, depending on the application (e.g. low-volume production or high-volume production) and whether or not chassis 140 of FIG. 3 incorporates compliance means 160, either a rigid plastic or an elastomeric embodiment of socket 201A may be preferred.

Chassis Considerations for Combined Use

Four embodiments of chassis 140 of FIG. 3 are described herein: chassis 140A of FIGS. 6-8, chassis 140B of FIGS. 10A and 10B, chassis 140C of FIGS. 11A and 11B, and chassis 170 of FIGS. 13-15B. These embodiments offer the following advantages and disadvantages:

- Chassis 140A is highly amenable to both 3D-printing and high-volume injection-molding.
- Chassis 140B can be fabricated using metal-stamping processes which are also suited to high-volume production (although with higher materials cost than injection-molded plastic).
- Chassis 140C is as amenable to 3D-printing and injection-molding as chassis 140A, and also offers a way to incorporate compliance means 160 of FIG. 3 in the form of elastomeric bosses. However, the elastomeric bosses are relatively unsuited to 3D-printing and require additional molds for injection-molding.
- Chassis 170 also offers a way to incorporate compliance means 160 and is well-suited to 3D-printing, but is not as amenable to injection-molding as chassis 140A or 140C due to its relatively complex living-hinge structures.

Motor Assembly Considerations for Combined use

Motor assembly 110A of FIGS. 4 and 5 includes motor carrier 116A (which can be of a rigid or elastomeric material) to hold N20-style gear-motor 111A, as well as rubber strip 117A to implement compliance means 160A, and magnet 118A to implement holding means 150A. Three alternative embodiments involving these elements are also described herein, offering the following advantages and disadvantages:

- Motor assembly 110A as described above, when carrier 116A is of a rigid plastic such as nylon, is highly amenable to prototyping and low-volume production because carrier 116A can be 3D-printed as well as injection-molded, and fabrication of assembly 110A requires no special tooling. Further, rubber strip 117A provides compliance, minimizing the need for other compliance means in the system. However, the need for three separate parts increases assembly labor which is disadvantageous for high-volume production.
- The motor carrier can also be fabricated of an elastomeric material, e.g. motor carrier 116B of FIG. 12A. The elastomeric properties provide compliance, eliminating the need for the rubber strip and thereby eliminating one step in the fabrication process. However, an elastomeric motor carrier is not amenable to 3-D printing.
- The magnet can be molded into the carrier, e.g. magnet 118C molded into carrier 116C of FIG. 12B. This simplifies assembly for high-volume production but could increase tooling costs. Further, a carrier with molded-in magnet may not be as amenable to 3D-printing for prototyping or low-volume production. As previously stated, carrier 116C can be fabricated of either a rigid or an elastomeric material, and the latter has the advantages of providing compliance and increasing the sliding resistance of the magnetic attachment between the motor assembly and a ferrous plate (due to the increased coefficient of friction possible with an elastomeric material).

As previously noted, a mounting magnet assembly—such as the cup magnet depicted in FIGS. 12C and 12D—is preferred over a simple magnet in embodiments which include a Hall-effect encoder for motor control.

FIG. 25: Preferred Combination for High-Volume Production

For applications involving high-volume production, minimization of material and assembly costs is more important than minimization of tooling costs. FIG. 25 shows the preferred combination of motorization system and coupler for such an application mounted on host blind 20 (also shown is a PCB 250, upon which the electronic components of FIG. 3 are mounted). This configuration consists of the following elements:

Chassis 140A, previously shown in FIGS. 6 and 7, envisioned to be fabricated of injection-molded nylon. The configuration of chassis 140A minimizes materials cost and also has the advantage of requiring only a simple mold.

Coupler 200A, previously shown in FIGS. 18B-18F, fabricated from an elastomer rather than a rigid plastic. Coupler 200A is preferred over the other couplers due to its ease of installation, while the use of an elastomeric material provides compliance and adds only a small incremental cost in high-volume production over a rigid plastic material.

A modified version of motor assembly 110A (previously shown in FIGS. 4 and 5) using motor carrier 116C (fabricated of an elastomeric material) of FIG. 12B. Carrier 116C incorporates magnet 118A and therefore subsumes the functions of carrier 116A, rubber strip 117A and magnet 118A, reducing the parts count and assembly labor. The added friction of the elastomeric material also increases the ability of the magnetic attachment between motor carrier 116C and plate 147A of chassis 140A to resist sliding or twisting over time.

The net compliance provided by elastomeric coupler 200A and motor carrier 116C is envisioned to be sufficient to accommodate typical misalignments.

FIG. 26: Preferred Combination for Prototype and Low-Volume Production

For applications involving prototyping or low-volume production, minimization of tooling costs is typically more important than minimizing material and assembly costs. FIG. 26 shows the preferred combination of motorization system and coupler for such an application, mounted on host blind 20 (also shown is PCB 250, upon which the electronic components of FIG. 3 are mounted). It consists of the following elements:

Chassis 140A, previously shown in FIGS. 6 and 7.

Coupler 200A, previously shown in FIGS. 18B-18F (fabricated of rigid plastic rather than an elastomer).

Motor assembly 110A, previously shown in FIGS. 4 and 5 (with carrier 116A fabricated of rigid plastic).

This configuration is amenable to 3D-printing as well as injection molding, and therefore requires no special tooling.

The net compliance provided by elastomeric coupler 200A and rubber strip 117A is envisioned to be sufficient to accommodate typical misalignments.

FIG. 27: Preferred Combination to Maximize Ability to Tolerate Misalignments It is envisioned that the combinations shown in FIGS. 25 and 26 will provide sufficient compliance to tolerate typical misalignments between the coupler and the control shaft of the host blind. However, in the eventuality that greater compliance is needed in practice, it could be advantageously provided by replacing chassis 140A of FIG. 25 with chassis 140C (incorporating elastomeric bosses) of FIGS. 11A and 11B.

Such a configuration is shown in FIG. 27, mounted on host blind 20 (also shown is PCB 250, upon which the electronic components of FIG. 3 are mounted).

This configuration provides three sources of compliance: elastomeric coupler 200A, elastomeric motor carrier 116C, and elastomeric bosses 145C and 146C. As noted previously herein, compliance from these sources contributes to backlash, which is undesirable. However, because the coupler configurations disclosed herein (including coupler 200A) minimize backlash, the net backlash of the configuration shown in FIG. 27 is expected to be within acceptable limits.

CONCLUSIONS, RAMIFICATIONS, AND SCOPE

As this disclosure makes clear, the external motorized actuator of the subject invention provides a simple, inexpensive, and easy-to-install way of motorizing the slat-tilt function of any wand-operated venetian blind. It is compatible with virtually all such blinds, can be installed without special tools and without need for removal of or modifications to the host blind, does not introduce excessive backlash between the motor and host blind, does not require complex or expensive components (e.g. flexible or extensible joints, sliding bearings, or machined slots), and is capable of mitigating the effects of misalignments.

Those skilled in the art will recognize that the construction and function of the elements composing the preferred and alternative embodiments described herein may be modified, eliminated, or augmented to realize many other useful embodiments, without departing from the scope and spirit of the invention as recited in the appended claims.

I claim:

1. A motorized blind assembly comprising a window blind and an actuator; said actuator comprising:

(a) a chassis having a first magnet and a tab, said first magnet having a first permanent magnetic surface, said tab having a ferromagnetic surface, said ferromagnetic surface oriented substantially perpendicularly to said first permanent magnetic surface; said chassis configured to attach to said blind via magnetic attraction between said first permanent magnetic surface and said blind, and (b) a motor assembly having an output shaft and a second magnet, said output shaft having an axis of rotation, said second magnet having a second permanent magnetic surface, said second permanent magnetic surface being substantially parallel to said axis of rotation, said motor assembly configured to attach to said chassis via magnetic attraction between said second permanent magnetic surface and said ferromagnetic surface;

whereby when said chassis is attached to said blind and said motor assembly is attached to said chassis, said motor assembly has a position and an orientation with respect to said blind, said position being adjustable in two dimensions via movement of said motor assembly on said ferromagnetic surface and said orientation being adjustable via rotation of said motor assembly on said ferromagnetic surface.

2. The motorized blind assembly of claim 1 wherein said first magnet is a mounting magnet.

3. The motorized blind assembly of claim 1 wherein said second magnet is a mounting magnet.

4. The motorized blind assembly of claim 3 wherein said motor assembly includes a Hall-effect sensor.

* * * * *